US010482705B2

(12) United States Patent
Hilbert et al.

(10) Patent No.: US 10,482,705 B2
(45) Date of Patent: Nov. 19, 2019

(54) GAMING MACHINE AND SYSTEM FOR CONCURRENT GAMING PLAYER INTERFACE MANIPULATION BASED ON VISUAL FOCUS

(71) Applicant: BALLY GAMING, INC., Las Vegas, NV (US)

(72) Inventors: Scott T. Hilbert, Sparks, NV (US); Martin Lyons, Henderson, NV (US); Anthony J. Baerlocher, Henderson, NV (US); Joel Jaffe, Glenview, IL (US); Kenneth Shawn Soong, Henderson, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 219 days.

(21) Appl. No.: 14/823,789

(22) Filed: Aug. 11, 2015

(65) Prior Publication Data

US 2017/0046906 A1 Feb. 16, 2017

(51) Int. Cl.
*G07F 17/32* (2006.01)

(52) U.S. Cl.
CPC ..... *G07F 17/3209* (2013.01); *G07F 17/3204* (2013.01); *G07F 17/3211* (2013.01); *G07F 17/3225* (2013.01); *G07F 17/3227* (2013.01)

(58) Field of Classification Search
CPC ... G06F 3/013; G07F 17/3262; G07F 17/3209
See application file for complete search history.

(56) References Cited

U.S. PATENT DOCUMENTS

| | | | | |
|---|---|---|---|---|
| 6,203,428 | B1 | 3/2001 | Giobbi et al. | 463/16 |
| 6,921,334 | B1 | 7/2005 | Bennett | 463/16 |
| 7,399,228 | B2 | 7/2008 | Baerlocher | 463/25 |
| 7,806,764 | B2 | 10/2010 | Brosnan et al. | 463/20 |
| 8,002,623 | B2 | 8/2011 | Resnick et al. | 463/19 |
| 8,070,592 | B2 | 12/2011 | Kromydas | 463/20 |
| 8,092,290 | B2 | 1/2012 | Darby | 463/13 |
| 8,182,332 | B2 | 5/2012 | Mitchell et al. | 463/21 |
| 8,231,464 | B2 | 7/2012 | Gelber et al. | 463/31 |
| 8,235,795 | B2 | 8/2012 | Green et al. | 463/20 |

(Continued)

*Primary Examiner* — David L Lewis
*Assistant Examiner* — Robert E Mosser
(74) *Attorney, Agent, or Firm* — Marvin A. Hein; David J. Bremer; Mark Thompson

(57) ABSTRACT

A gaming system includes one or more input devices, audio output devices, visual display devices, and information processors. At least one visual display device visually depicts a plurality of visual presentations and at least one audio output device renders audio selectively mixed from corresponding audio components of the visual presentations. At least one processor receives and processes information from at least one input device to determine a region of focused attention by the player with respect to the visual display devices. Using the region of focused attention, a corresponding primary visual presentation is determined from the plurality of visual presentations. The corresponding audio components of the plurality of presentations are selectively mixed such that the audio component of the primary visual presentation is dominant on at least one audio output device. The plurality of visual presentations may also be rearranged or altered to visually highlight the primary visual presentation.

18 Claims, 12 Drawing Sheets

(56) References Cited

U.S. PATENT DOCUMENTS

| | | | | |
|---|---|---|---|---|
| 8,267,763 | B2 | 9/2012 | Anderson et al. | 463/16 |
| 8,272,935 | B2 | 9/2012 | Anderson et al. | 463/17 |
| 8,435,122 | B2 | 5/2013 | Hornik et al. | 463/42 |
| 8,506,403 | B2 | 8/2013 | Muir et al. | 463/40 |
| 8,540,567 | B2 | 9/2013 | Nelson et al. | 463/25 |
| 8,550,897 | B2 | 10/2013 | Hornik et al. | 463/20 |
| 8,608,540 | B2 | 12/2013 | Bennett | 463/16 |
| 8,613,648 | B2 | 12/2013 | Aoki et al. | 463/16 |
| 8,613,650 | B2 | 12/2013 | Kovacs et al. | 463/16 |
| 8,613,660 | B2 | 12/2013 | Vallejo et al. | 463/29 |
| 8,672,750 | B2 | 3/2014 | Nelson et al. | 463/26 |
| 8,715,070 | B2 | 5/2014 | Cannon et al. | 463/25 |
| 8,740,685 | B2 | 6/2014 | Stevens et al. | 463/16 |
| 8,814,691 | B2 | 8/2014 | Haddick et al. | |
| 8,882,579 | B2 | 11/2014 | Green et al. | 463/20 |
| 8,888,588 | B2 | 11/2014 | Vallejo et al. | 463/29 |
| 8,951,121 | B2 | 2/2015 | Lyons et al. | 463/37 |
| 8,986,125 | B2 | 3/2015 | Ellsworth | |
| 2005/0026670 | A1* | 2/2005 | Lardie | G07F 17/32 463/16 |
| 2009/0124340 | A1 | 5/2009 | Visser | 463/20 |
| 2009/0305765 | A1 | 12/2009 | Walker et al. | |
| 2010/0216533 | A1 | 8/2010 | Crawford, Jr. et al. | |
| 2010/0268604 | A1 | 10/2010 | Kim et al. | |
| 2011/0028205 | A1 | 2/2011 | Parrott | 463/25 |
| 2011/0153362 | A1 | 6/2011 | Valin et al. | |
| 2011/0223980 | A1 | 9/2011 | Stearns et al. | 463/1 |
| 2012/0004956 | A1 | 1/2012 | Huston et al. | |
| 2012/0121161 | A1 | 5/2012 | Eade et al. | |
| 2012/0182573 | A1 | 7/2012 | Mok | |
| 2012/0239175 | A1 | 9/2012 | Mohajer et al. | |
| 2012/0295698 | A1 | 11/2012 | Demino et al. | |
| 2013/0023337 | A1* | 1/2013 | Bowers | G07F 17/32 463/25 |
| 2013/0079116 | A1 | 3/2013 | Nelson et al. | 463/25 |
| 2013/0326082 | A1 | 12/2013 | Stokking et al. | |
| 2014/0087841 | A1 | 3/2014 | Council et al. | 463/25 |
| 2014/0171039 | A1 | 6/2014 | Bjontegard | |
| 2014/0180674 | A1 | 6/2014 | Neuhauser et al. | |
| 2014/0253326 | A1 | 9/2014 | Cho et al. | |
| 2015/0065214 | A1 | 3/2015 | Olson et al. | |
| 2015/0072766 | A1 | 3/2015 | Hughes et al. | 463/25 |
| 2015/0286873 | A1 | 10/2015 | Davis et al. | |
| 2015/0287265 | A1 | 10/2015 | Lyons et al. | |
| 2015/0293587 | A1* | 10/2015 | Wilairat | G06F 3/013 348/143 |
| 2016/0379176 | A1 | 12/2016 | Brailovskiy et al. | |

* cited by examiner

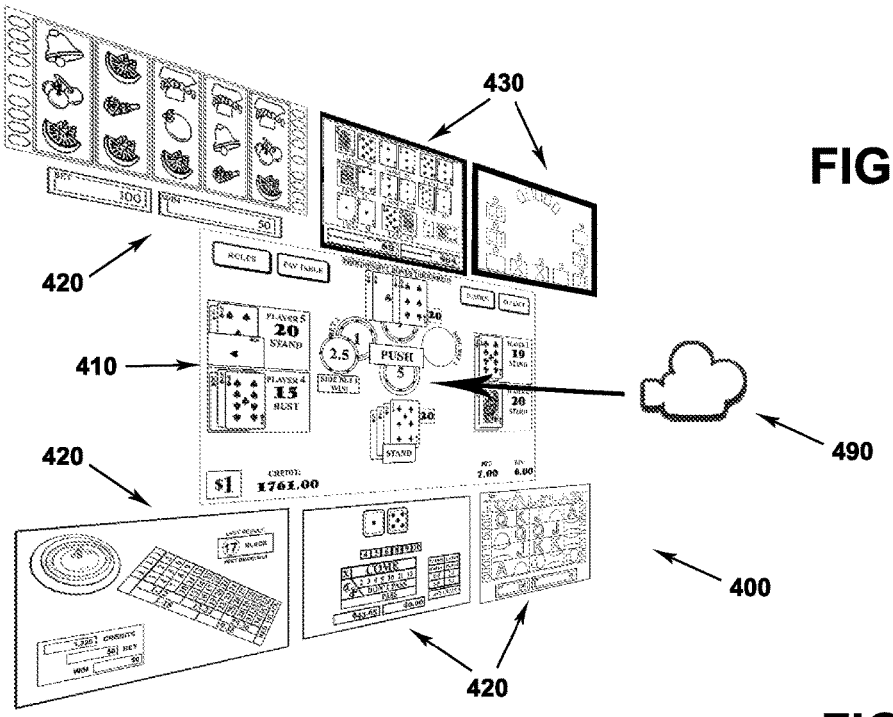
FIG. 7A
FIG. 7B
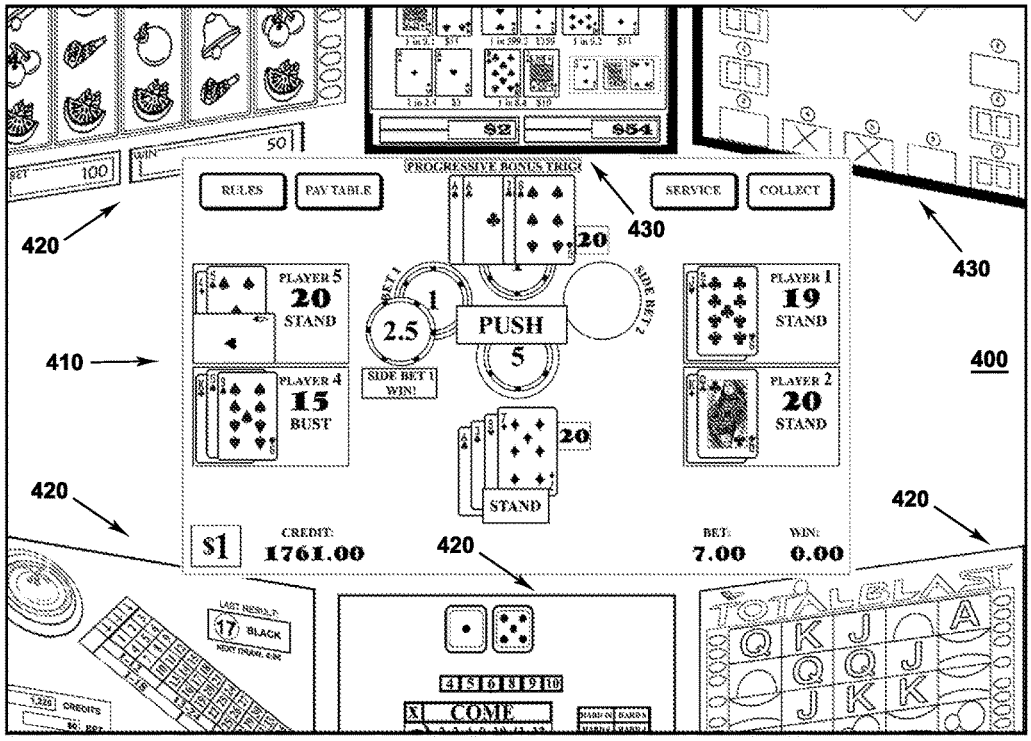

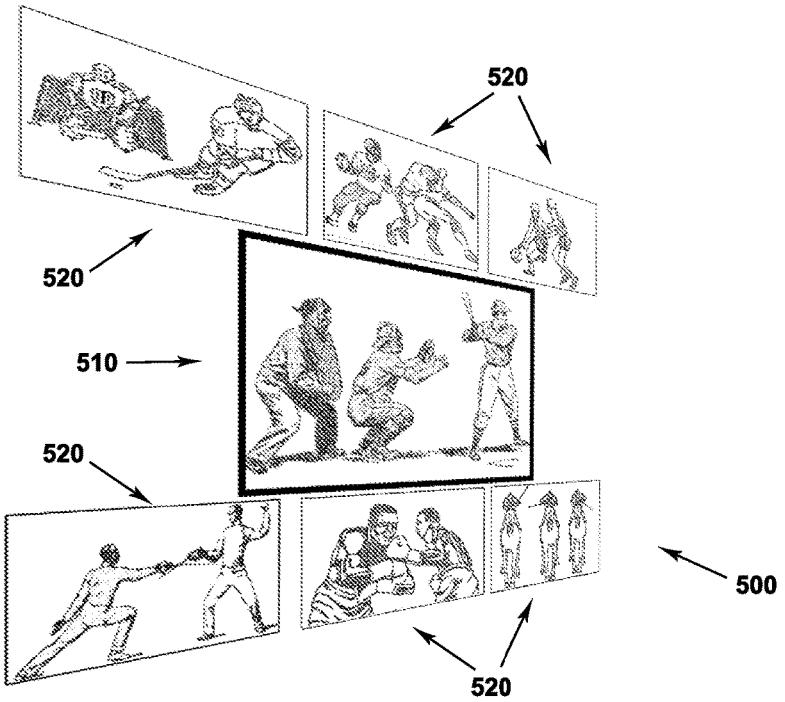
FIG. 8A
FIG. 8B
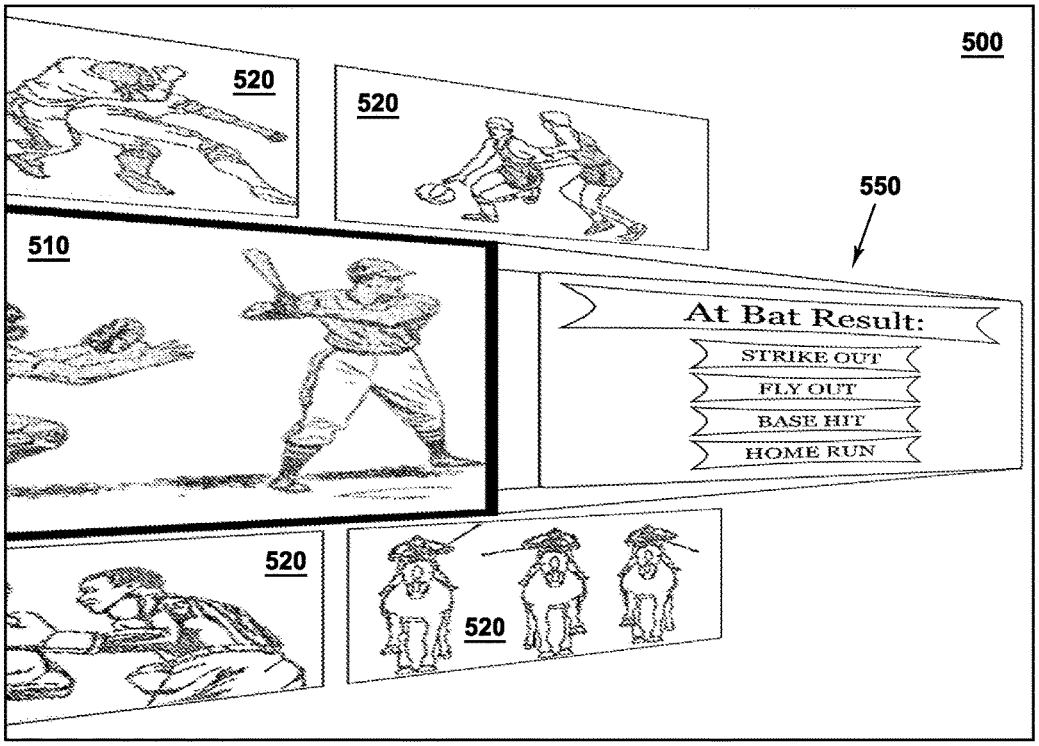

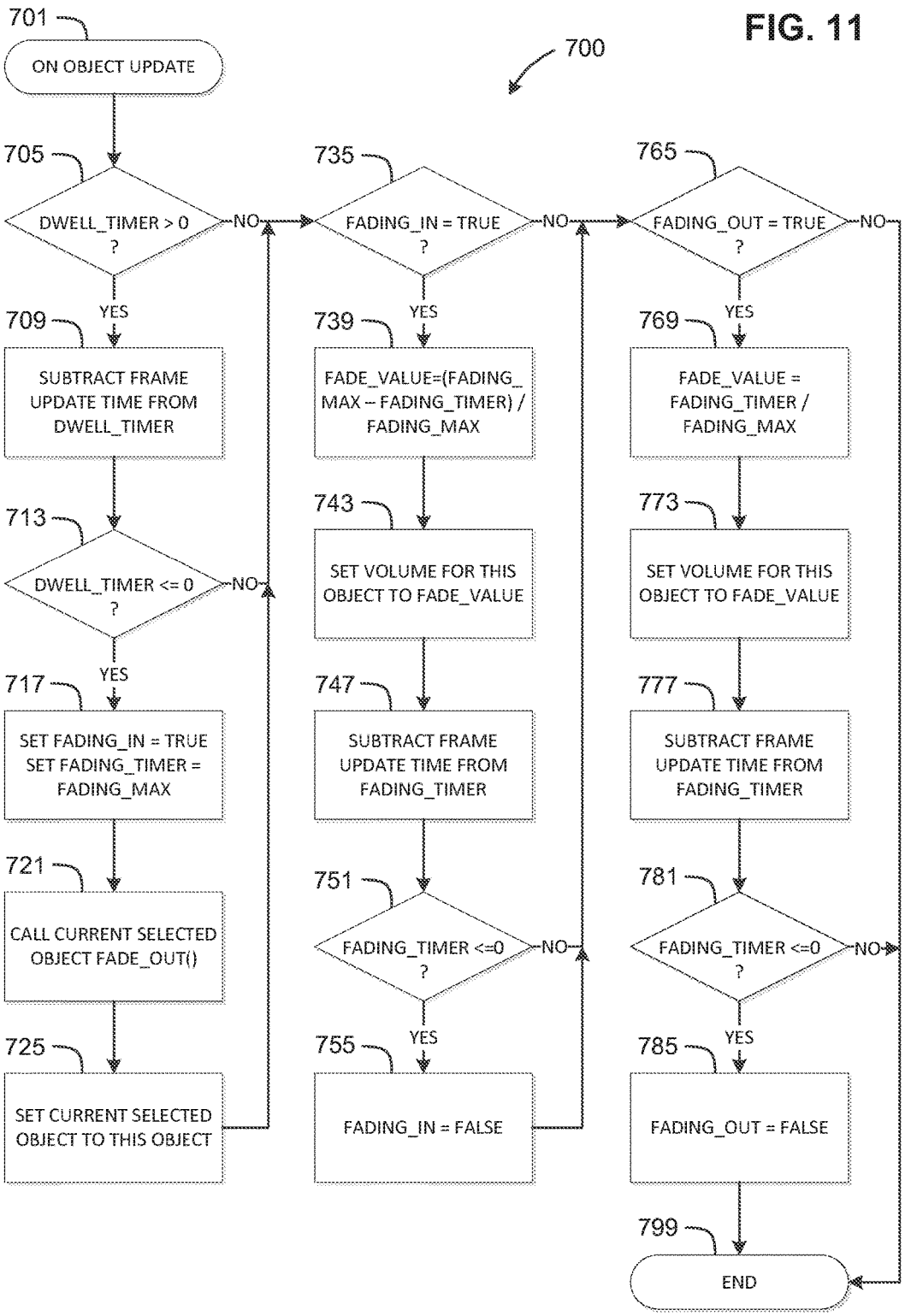
FIG. 11
700
701
ON OBJECT UPDATE
705
DWELL_TIMER > 0 ?
NO
YES
709
SUBTRACT FRAME UPDATE TIME FROM DWELL_TIMER
713
DWELL_TIMER <= 0 ?
NO
YES
717
SET FADING_IN = TRUE SET FADING_TIMER = FADING_MAX
721
CALL CURRENT SELECTED OBJECT FADE_OUT()
725
SET CURRENT SELECTED OBJECT TO THIS OBJECT
735
FADING_IN = TRUE ?
NO
YES
739
FADE_VALUE=(FADING_MAX – FADING_TIMER) / FADING_MAX
743
SET VOLUME FOR THIS OBJECT TO FADE_VALUE
747
SUBTRACT FRAME UPDATE TIME FROM FADING_TIMER
751
FADING_TIMER <=0 ?
NO
YES
755
FADING_IN = FALSE
765
FADING_OUT = TRUE ?
NO
YES
769
FADE_VALUE = FADING_TIMER / FADING_MAX
773
SET VOLUME FOR THIS OBJECT TO FADE_VALUE
777
SUBTRACT FRAME UPDATE TIME FROM FADING_TIMER
781
FADING_TIMER <=0 ?
NO
YES
785
FADING_OUT = FALSE
799
END

GAMING MACHINE AND SYSTEM FOR CONCURRENT GAMING PLAYER INTERFACE MANIPULATION BASED ON VISUAL FOCUS

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming systems, apparatus, and methods and, more particularly, to the determination of an area of focus by a player presented with a plurality of visual presentations and the selective generation of audio and video imagery presented to the player in response to the determined area of focus.

BACKGROUND OF THE INVENTION

The gaming industry depends upon player participation. Players are generally "hopeful" players who either think they are lucky or at least think they can get lucky—for a relatively small investment to play a game, they can get a disproportionately large return. To create this feeling of luck, a gaming apparatus relies upon an internal or external random element generator to generate one or more random elements such as random numbers. The gaming apparatus determines a game outcome based, at least in part, on the one or more random elements.

When a player is presented with multiple visual presentations simultaneously, it can become confusing or overwhelming for the player to observe the entirety of the content being displayed. Further, collectively mixing audio components for simultaneous visual presentations can result in rendering resultant audio content related to a given presentation incomprehensible and unintelligible. The merging of simultaneous audio content can often result in a garbled assembly of audio having no distinguishable elements. Thus, a combination of selective audio components mixed and rendered during multiple visual presentations is desirable. Further, the manipulations of one or more audio and visual presentations may further enhance player content recognition and interface aesthetics.

As the industry matures, the creativity and ingenuity required to improve the operation of gaming apparatuses and player interfaces incorporating multiple, concurrent video and audio presentations grows accordingly.

SUMMARY OF THE INVENTION

According to one aspect of the present invention, a gaming system for visually and audibly presenting a user interface including a plurality of visual presentations to a player concurrently is disclosed. The gaming system comprises one or more output devices, one or more input devices, and one or more processors. The gaming system may be incorporated into a single, freestanding gaming machine or implemented on a distributed system within a given environment, like a casino or sportsbook establishment. Each of the visual presentations has a corresponding audio component associated with the visual presentation. The one or more output devices include one or more visual output devices and one or more audio output devices. The visual output devices display the plurality of visual presentations. The one or more input devices are configured to generate positional input related to a determined visual perception of the player relative to the one or more visual output devices. The one or more processors are configured to receive the positional input and determine a center of attention of the player from the positional input. The one or more processors designate a primary visual presentation from the plurality of visual presentations corresponding to the center of attention and selectively mix the audio components of the plurality of visual presentations. The audio component of the primary visual presentation is presented dominantly on the one or more audio output devices.

According to one aspect of the present invention, a gaming system is configured to visually and audibly present a user interface including a plurality of visual presentations concurrently to a player in virtual-reality environment. Each of the visual presentations has a corresponding audio component. The gaming system comprises a headset, one or more audio output units, and one or more processors. The headset includes one or more visual output units and one or more orientation sensors. The one or more visual output units are configured to display the plurality of visual presentations. The one or more orientation sensors are configured to generate positional information related to a determined focal point of a player in a visual field relative to the one or more visual output devices. The one or more audio output units are configured to output audio components of the plurality of visual presentations. The one or more processors are configured to receive the positional information from the one or more input devices. The processors then determine a center of attention of the player from the positional information and designate a primary visual presentation from the plurality of visual presentations corresponding to the center of attention. The processors also selectively mix the audio components of the plurality of visual presentation and present the audio component of the primary visual presentation dominantly on the one or more audio output devices.

According to one aspect of the present invention, a gaming system is configured to visually and audibly present a user interface including a plurality of visual presentations concurrently to a player. Each visual presentation has a corresponding audio component. The gaming system comprises one or more visual output devices, one or more audio output devices, one or more input devices, and one or more processors. The one or more visual output devices display the plurality of visual presentations. The one or more audio output devices are configured to selectively present audio presented to the player relating to the plurality of visual presentations. The one or more input devices are configured to generate positional input related to an orientation of the player relative to the one or more visual output devices. The one or more processors are configured to receive the positional input from the one or more input devices. The processors determine a center of attention of the player from the positional input and designate a primary visual presentation corresponding to one of the plurality of visual presentation at the center of attention. The processors also selectively mix the audio components of the plurality of visual presentations, and simultaneously present, on the one or more audio output devices, a dominant primary audio component corresponding to the primary visual presentation and a less dominant secondary audio component generated from the audio components of the non-primary plurality of visual presentations.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

FIG. 7A is an image of a virtual-reality environment used to generate a player interface for concurrent gaming, according to an embodiment of the present invention.

FIG. 7B is an image of a concurrent-gaming player interface, according to an embodiment of the present invention.

FIG. 8A is an image of a virtual-reality environment used to generate a concurrent-gaming player interface for a sportsbook casino environment, according to an embodiment of the present invention.

FIG. 8B is an image of a virtual-reality environment used to generate a concurrent-gaming player interface having a contextual menu for a sporting event, according to an embodiment of the present invention.

FIG. 11 is a flowchart for a data processing method performed in response to a visual object specifically requiring audio content updating, according to an embodiment of the present invention.

Figure 1:
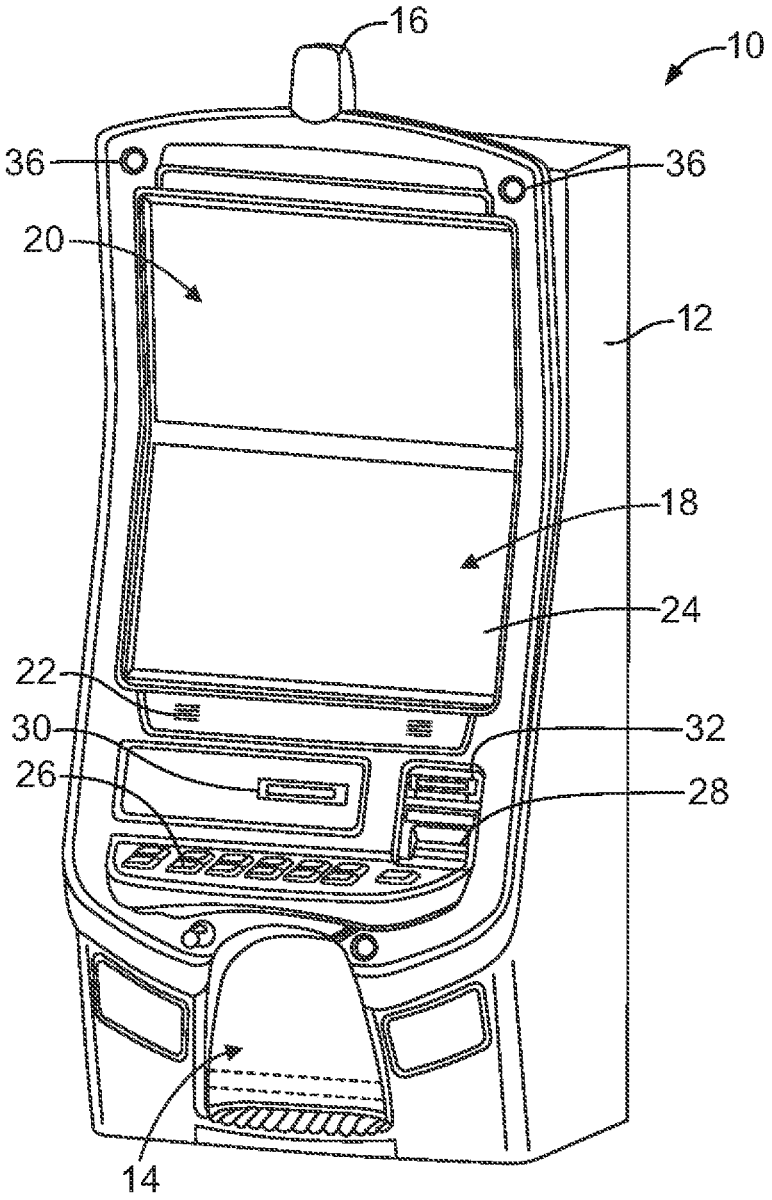
FIG. 1 is a perspective view of a free-standing gaming machine according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

For purposes of the present detailed description, the terms "user interface," "interface," "visual field," "audio field," "pick field," "virtual reality," "visual/audio presentation/component," and the like describe aspects of an interaction between an electronic device and the player. This interaction includes perceivable output (e.g., audio, video, tactile, etc.) that is observed by the player, as well as electronically-generated input generated from real-world events (e.g., actuated buttons, physical position information, etc.) caused by the player or another real-world entity. In some embodiments, perceivable output may include a variety of information presented to a player (e.g., live sporting events, live casino gaming events, computer generated wagering games, etc.) using a number of perceivable stimuli, in a variety of formats using a variety of equipment (e.g., flat screen-computer monitor, curved monitor, virtual-reality headset, three-dimensional television, audio loudspeakers, audio headphones, directional audio, hypersonic sound projector, ranged acoustic device, three-dimensional audio, etc.). In some embodiments, electronically-generated input may include actuating or specifying specific regions or buttons of keyboards or touchscreens, detecting physical positions of pointing devices or sensors using relative or absolute measurements, and/or processing information gathered from one or more input devices to derive a resultant input signal containing information further processed by electronic equipment to achieve a desired result.

For purposes of the present detailed description, the term "concurrent gaming" includes the simultaneous presentation and participation of games in which a player interacts with whether passively or actively. In one embodiment, interaction with each presentation may include simple observation of one or more active presentations. In another embodiment, a player interface may present one or more presentations relating to a subset of games that are conducted simultaneously, even if some of the games are not presented. In other embodiments, a complex relationship of player input with one or more presentations and corresponding output is performed to achieve a dynamic feedback loop between the player and each of the performed individual games or events in addition to the entire interface as a whole.

Referring to FIG. 1, there is shown a gaming machine 10 similar to those operated in gaming establishments, such as casinos. With regard to the present invention, the gaming machine 10 may be any type of gaming terminal or machine and may have varying structures and methods of operation. For example, in some aspects, the gaming machine 10 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may take any suitable form, such as floor-standing models as shown, handheld mobile units, bartop models, workstation-type console models, etc. Further, the gaming machine 10 may be primarily dedicated for use in playing wagering games, or may include non-dedicated devices, such as mobile phones, personal digital assistants, personal computers, etc. Exemplary types of gaming machines are disclosed in U.S. Pat. Nos. 6,517,433, 8,057,303, and 8,226,459, which are incorporated herein by reference in their entireties.

The gaming machine 10 illustrated in FIG. 1 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more front doors that are locked and require a physical or electronic key to gain access to the interior compartment of the cabinet 12 behind the locked door. The cabinet 12 forms an alcove 14 configured to store one or more beverages or personal items of a player. A notification mechanism 16, such as a candle or tower light, is mounted to the top of the cabinet 12. It flashes to alert an attendant that change is needed, a hand pay is requested, or there is a potential problem with the gaming machine 10.

The input devices, output devices, and input/output devices are disposed on, and securely coupled to, the cabinet 12. By way of example, the output devices include a primary display 18, a secondary display 20, and one or more audio speakers 22. The primary display 18 or the secondary display 20 may be a mechanical-reel display device, a video display device, or a combination thereof in which a transmissive video display is disposed in front of the mechanical-reel display to portray a video image superimposed upon the mechanical-reel display. The displays variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 24 mounted over the primary or secondary displays, buttons 26 on a button panel, a bill/ticket acceptor 28, a card reader/writer 30, a ticket dispenser 32, and player-accessible ports (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

The player input devices, such as the touch screen 24, buttons 26, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. In order to deposit cash or credits onto the gaming machine 10, the value input devices are configured to detect a physical item associated with a monetary value that establishes a credit balance on a credit meter such as the "credits" meter 84 (see FIG. 3). The physical item may, for example, be currency bills, coins, tickets, vouchers, coupons, cards, and/or computer-readable storage mediums. The deposited cash or credits are used to fund wagers placed on the wagering game played via the gaming machine 10. Examples of value input devices include, but are not limited to, a coin acceptor, the bill/ticket acceptor 28, the card reader/writer 30, a wireless communication interface for reading cash or credit data from a nearby mobile device, and a network interface for withdrawing cash or credits from a remote account via an electronic funds transfer. In response to a cashout input that initiates a payout from the credit balance on the "credits" meter 84 (see FIG. 3), the value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer 30, the ticket dispenser 32 for printing tickets redeemable for cash or credits, a wireless communication interface for transmitting cash or credit data to a nearby mobile device, and a network interface for depositing cash or credits to a remote account via an electronic funds transfer.

Modern gaming equipment is capable of presenting a player with a multitude of audio and video presentations simultaneously. Presentations may include wagering games (e.g., video poker, video slots, virtual multi-player card games, etc.), in-progress sporting events (e.g., baseball/football games, remote wagering games, etc.), advertisements and promotional content (e.g., casino-related offers, player club features, automated food/drink ordering, etc.), and other multimedia content (e.g., television shows, movies, music, etc.). The presentations may be displayed on one or more display devices, being fully partitioned and/or collectively organized. The ability to pick a wagering game title from amongst a library of released wagering games and play the multiple selected wagering games simultaneously is disclosed in another U.S. patent application assigned to Bally Gaming, Inc., having Ser. No. 14/499,007, by Scott Hilbert, filed on Sep. 26, 2014, titled "USER INTERFACE FEATURES IN A SYSTEM OF CONCURRENT GAMES," which is incorporated herein by reference in its entirety.

In one embodiment, the gaming machine 10 is equipped to simultaneously display a plurality of visual presentations. The visual presentations may include concurrently performed wagering games and other multimedia. The audio for the visual presentations is presented using audio speakers 22. Thus, the gaming machine 10 is configured to simultaneously display a plurality of visual presentations on one or more of the visual output devices (e.g., display 18, 20) and present corresponding audio for the visual presentations using one or more audio output devices (e.g., speakers 22).

Currently, when a large screen is used for multiple concurrent visually presented games, navigation between the visual presentations can be burdensome. Navigation generally requires manually moving a cursor from window to window to react to situations in each window, or automatically switching window focus as gaming events occur in the various windows, potentially confusing the player as to what region of the screen is currently active. Using various methods as disclosed (including head-tracking, eye-tracking, and gaze-tracking, menu and item selection in one or more of the visual presentations) provides a large increase in efficiency in the player interface. A player can quickly and selectively refocus on different visual regions of the display to make selections and switch between regions of interest without having to physically or manually move a cursor.

In one embodiment, a gaming machine 10 is configured to concurrently display and conduct multiple visual presentations simultaneously. Some or all of these presentations may be wagering games dependent upon a local or remote random number generator (RNG) as detailed below. On larger output displays (and the use of multiple display devices), the number of distinct presentations that can be displayed is practically unlimited. Each of the presentations may be independent from all the others, each relying on an RNG, event occurrence, and other determinations that are performed locally or remotely.

In other embodiments, one or more of the visual presentations may include sporting events that permit wagering options on events during the events. For example, a "sportsbook" enables a player to wager on various sporting competitions that are generally displayed in parallel on a variety of display screens. Audio feed(s) may be individually presented to players in a sportsbook using dedicated audio speakers mounted in the player's chair, mobile devices or headsets, directional/spatialized audio field(s), or modulated ultrasound, among other methods. A virtual sportsbook may also be used to display a large number of simultaneous sporting events side-by-side, for example, using a head-mounted virtual-reality headset. Generally, the virtual-reality headset has integrated or associated headphones or audio devices to present audio to the player that relates to the virtual-reality content.

The player input devices, such as the touch screen 24, buttons 26, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. The value input devices are used to deposit cash or credits onto the gaming machine 10. The cash or credits are used to fund wagers placed on the wagering game played via the gaming machine 10. Examples of value input devices include, but are not limited to, a coin acceptor, the bill/ticket acceptor 28, the card reader/writer 30, a wireless communication interface for reading cash or credit data from a nearby mobile device, and a network interface for withdrawing cash or credits from a remote account via an electronic funds transfer. The value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer 30, the ticket dispenser 32 for printing tickets redeemable for cash or credits, a wireless communication interface for transmitting cash or credit data to a nearby mobile device, and a network interface for depositing cash or credits to a remote account via an electronic funds transfer.

In general, placing wagers, redeeming credits, and initiating wagering games are a result of the player providing input specifying the desired function. Player input may include actuating button(s), pressing regions on a touchscreen, using a pointing device, controlling a cursor, etc., via the player input devices. In one embodiment, the gaming machine 10 includes one or more player input devices that generate positional input (not shown). For example, positional input may relate to a position of sensors in a headset used by the player.

One or more passive input devices may also be employed as a part of the gaming machine 10. For example, one or more cameras 36 may be mounted in or on the gaming machine cabinet 12. The cameras 36 are positioned to gather image data that can be processed by the gaming machine 10 (or another component of the gaming system as a whole) to generate positional input information that can be used to discern an area of visual attention of the player. For example, image processing may generate positional input information related to head and/or eye position and orientation of the player in front of the gaming machine 10. Alternatively, a virtual-reality headset (not shown) and/or one or more sensors or detectors may be used to generate and passively report positional input information, orientation, and responsiveness or gestures of the player's head and/or eyes.

Other devices that may be present and coupled to the gaming machine 10 to perform specific functions include combination input/output devices that may gather player input information from sensors, buttons, detected gestures, etc., while simultaneously presenting output information of one or more wagering game or other multimedia. For example, a virtual-reality head-mounted display may function as both an output display device and an input information gathering device. One example of this type of combination input/output device is the virtual-reality headset and functional processing unit sold as the Oculus Rift™ or Samsung Gear VR™, manufactured by Oculus VR of Menlo Park, Calif., USA. Other products offered by this company or others may be coupled to the gaming machine 10, the headset, etc., and may include further input and output devices like pointers, actuation buttons, audio speakers, etc. One advantage of using a combination input/output device includes the offloading of processing from the gaming machine 10, when possible. Thus, the combination input/output device(s) may perform functions and processing in parallel to the gaming machine 10, while simultaneously presenting audio and/or video content to the player.

Figure 2:
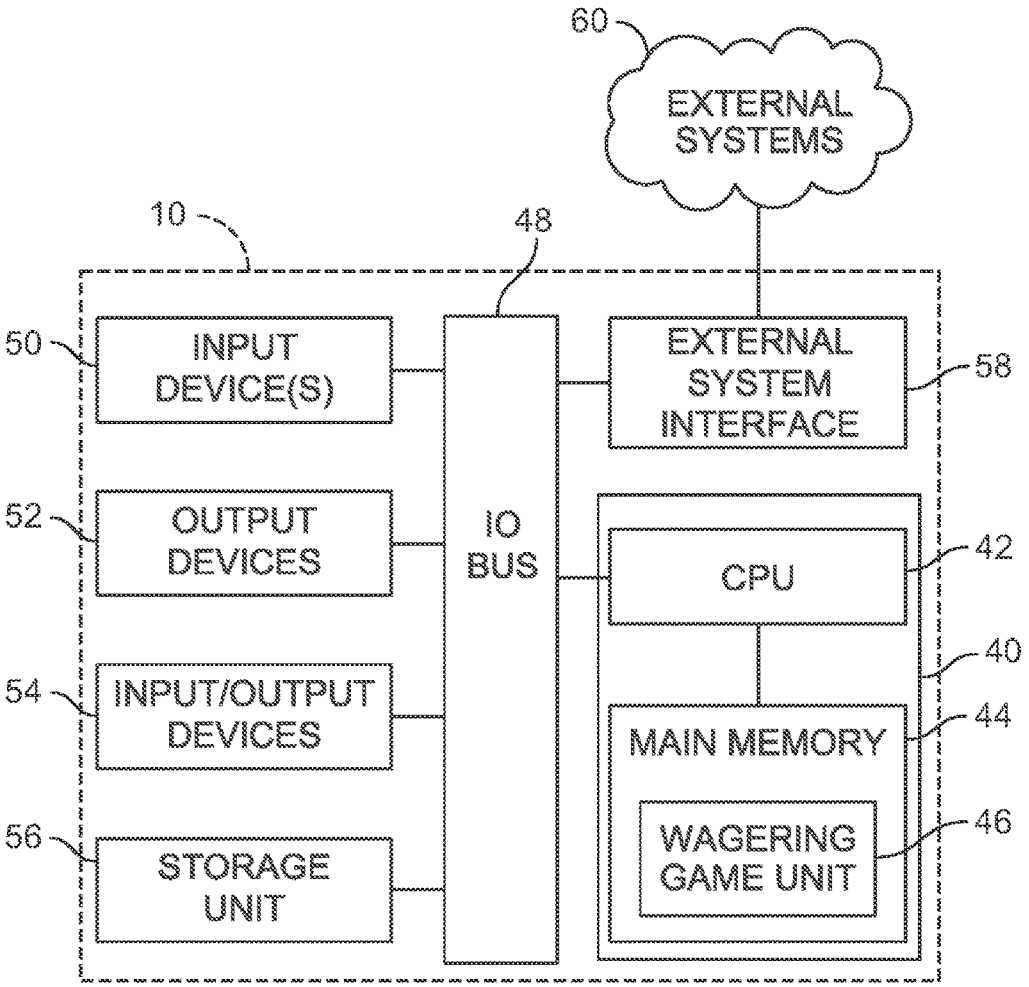
FIG. 2 is a schematic view of a gaming system according to an embodiment of the present invention.

Turning now to FIG. 2, there is shown a block diagram of the gaming-machine architecture. The gaming machine 10 includes game-logic circuitry 40 securely housed within a locked box inside the gaming cabinet 12 (see FIG. 1). The game-logic circuitry 40 includes a central processing unit (CPU) 42 connected to a main memory 44 that comprises one or more memory devices. The CPU 42 includes any suitable processor(s), such as those made by Intel and AMD. By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. The main memory 44 includes a wagering-game unit 46. In one embodiment, the wagering-game unit 46 causes wagering games to be presented, such as video poker, video blackjack, video slots, video lottery, etc., in whole or part.

The game-logic circuitry 40 is also connected to an input/output (I/O) bus 48, which can include any suitable bus technologies, such as an AGTL+frontside bus and a PCI backside bus. The I/O bus 48 is connected to various input devices 50, output devices 52, and input/output devices 54 such as those discussed above in connection with FIG. 1. The I/O bus 48 is also connected to a storage unit 56 and an external-system interface 58, which is connected to external system(s) 60 (e.g., wagering-game networks).

The external system 60 includes, in various aspects, a gaming network, other gaming machines or terminals, a gaming server, a remote controller, communications hardware, or a variety of other interfaced systems or components, in any combination. In yet other aspects, the external system 60 comprises a player's portable electronic device (e.g., cellular phone, electronic wallet, etc.) and the external-system interface 58 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)—all of which obtained regulatory approval from a gaming control board or commission and are verified by a trusted authentication program in the main memory 44 prior to game execution. The authentication program generates a live authentication code (e.g., digital signature or hash) from the memory contents and compare it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both are not allowed to perform or execute the RNG programming or game-outcome logic in a regulatory-approved manner and are therefore unacceptable for commercial use. In other words, through the use of the authentication program, the game-logic circuitry facilitates operation of the game in a way that a person making calculations or computations could not.

When a wagering-game instance is executed, the CPU 42 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player, for example, at a minimum of 100 Hz (100 calls per second) as set forth in Nevada's New Gaming Device Submission Package. Accordingly, the RNG cannot be carried out manually by a human and is integral to operating the game.

The gaming machine 10 may be used to play central determination games, such as electronic pull-tab and bingo games. In an electronic pull-tab game, the RNG is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

The gaming machine 10 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 3:
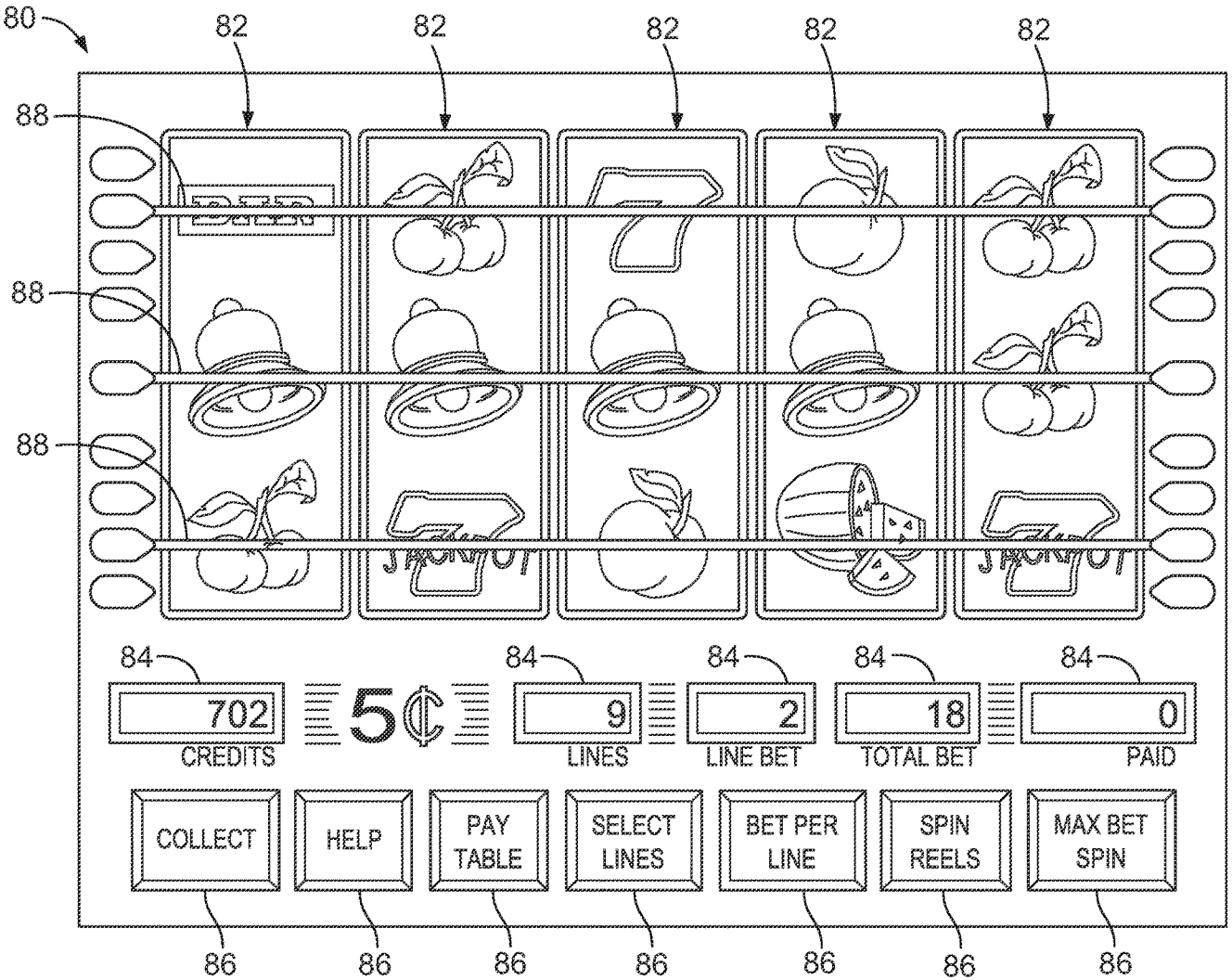
FIG. 3 is an image of an exemplary basic-game screen of a wagering game displayed on a gaming machine, according to an embodiment of the present invention.

Referring now to FIG. 3, there is illustrated an image of a basic-game screen 80 adapted to be displayed on the primary display 18 or the secondary display 20. The basic-game screen 80 portrays a plurality of simulated symbol-bearing reels 82. Alternatively or additionally, the basic-game screen 80 portrays a plurality of mechanical reels or other video or mechanical presentation consistent with the game format and theme. The basic-game screen 80 also advantageously displays one or more game-session credit meters 84 and various touch screen buttons 86 adapted to be actuated by a player. A player can operate or interact with the wagering game using these touch screen buttons or other input devices such as the buttons 26 shown in FIG. 1. The game-logic circuitry 40 operates to execute a wagering-game program causing the primary display 18 or the secondary display 20 to display the wagering game.

In response to receiving an input indicative of a wager covered by or deducted from the credit balance on the "credits" meter 84, the reels 82 are rotated and stopped to place symbols on the reels in visual association with paylines such as paylines 88. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 18 or secondary display 20) through the display of information such as, but not limited to, text, graphics, static images, moving images, etc., or any combination thereof. In accord with the method of conducting the wagering game, the game-logic circuitry 40 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 40 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 42 causes the recording of a digital representation of the wager in one or more storage media (e.g., storage unit 56), the CPU 42, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM, etc.). The noted second state of the data storage media comprises storage in the storage media of data representing the electronic data signal from the CPU 42 (e.g., the wager in the present example). As another example, the CPU 42 further, in accord with the execution of the stored instructions relating to the wagering game, causes the primary display 18, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 40 to determine the outcome of the wagering-game instance. In at least some aspects, the game-logic circuitry 40 is configured to determine an outcome of the wagering-game instance at least partially in response to the random parameter.

In one embodiment, the gaming machine 10 and, additionally or alternatively, the external system 60 (e.g., a gaming server), means gaming equipment that meets the hardware and software requirements for fairness, security, and predictability as established by at least one state's gaming control board or commission. Prior to commercial deployment, the gaming machine 10, the external system 60, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions. As can be seen from the description herein, the gaming machine 10 may be implemented with hardware and software architectures, circuitry, and other special features that differentiate it from general-purpose computers (e.g., desktop PCs, laptops, and tablets).

Figure 4:
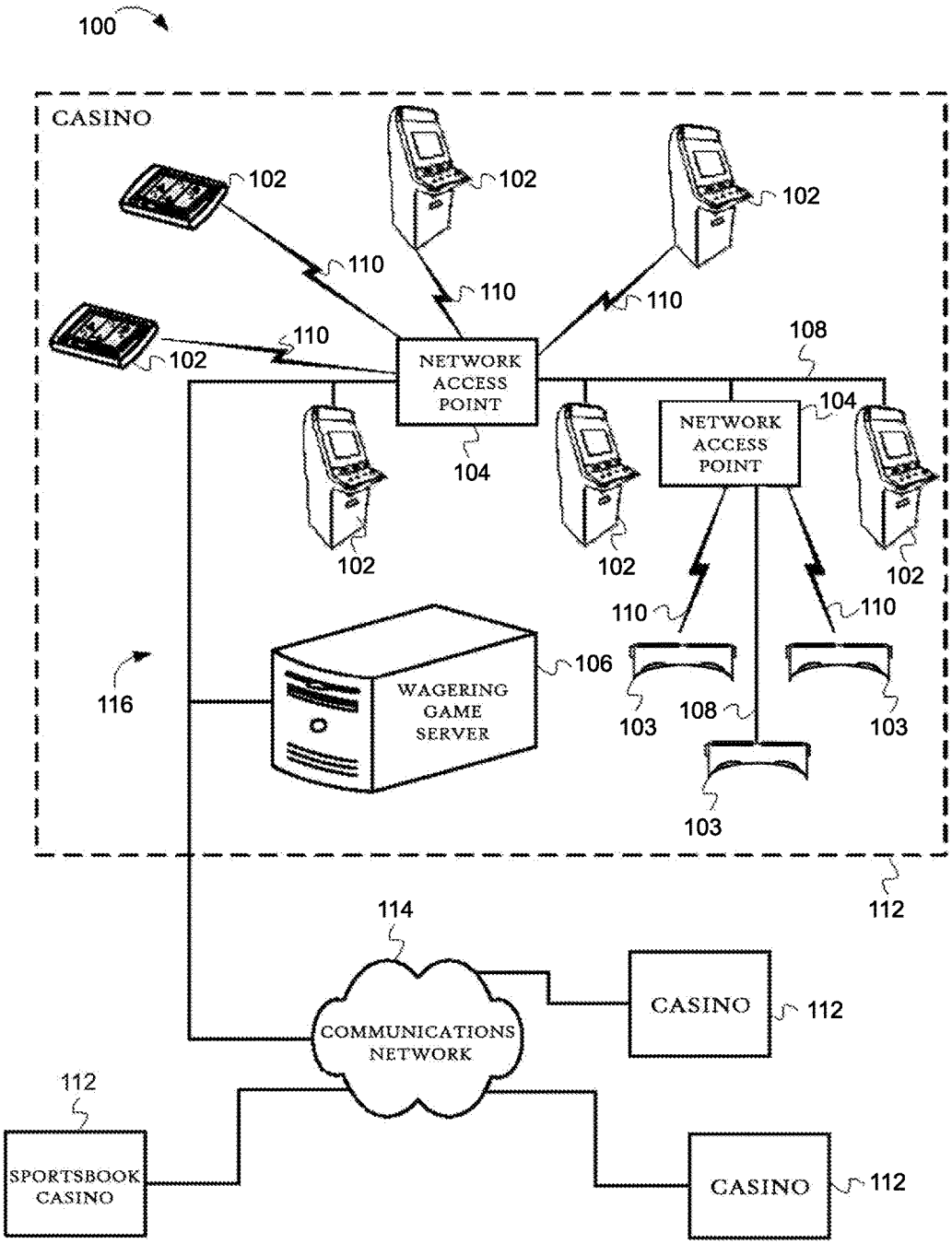
FIG. 4 is a schematic view of a wagering gaming system according to an embodiment of the present invention.

Referring now to FIG. 4, a wagering game network 100 is shown according to an example embodiment of the invention. The wagering game network 100 includes a plurality of casinos 112 connected to a communications network 114. Each casino 112 includes a local area network 116, which includes an access point 104, a wagering game server 106, wagering game machines 102, and virtual-reality headsets 103. The access points 104 provide wireless communication links 110 and wired communication links 108. The wired and wireless communication links can employ any suitable connection technology, such as Bluetooth, 802.11, Ethernet, public switched telephone networks, SONET, etc. In some embodiments, the wagering game server 106 can serve wagering games and distribute content to devices located in other casinos 112 or at other locations on the communications network 114. One or more of the casinos 112 may include a sportsbook casino enabling wagering players to wager on live or time-delayed sporting events.

The wagering game machines 102 described herein can take any suitable form, such as floor standing models, handheld mobile units, bartop models, workstation-type console models, etc. Further, the wagering game machines 102 can be primarily dedicated for use in conducting wagering games, or can include non-dedicated devices, such as mobile phones, personal digital assistants, personal computers, etc. In one embodiment, the wagering game network 100 can include other network devices, such as accounting servers, wide area progressive servers, player tracking servers, and/or other devices suitable for use in connection with embodiments of the invention.

In some embodiments, wagering game machines 102 and wagering game servers 106 work together such that a wagering game machine 102 can be operated as a thin, thick, or intermediate client. For example, one or more elements of game play may be controlled by the wagering game machine 102 (client) or the wagering game server 106 (server). Game play elements can include executable game code, lookup tables, configuration files, game outcome, audio or visual representations of the game, game assets or the like. In a thin-client example, the wagering game server 106 can perform functions such as determining game outcome or managing assets, while the wagering game machine 102 can present a graphical representation of such outcome or asset modification to the user (e.g., player). In a thick-client example, the wagering game machines 102 can determine game outcomes and communicate the outcomes to the wagering game server 106 for recording or managing a player's account.

In some embodiments, either the wagering game machines 102 (client) or the wagering game server 106 can provide functionality that is not directly related to game play. For example, account transactions and account rules may be managed centrally (e.g., by the wagering game server 106) or locally (e.g., by the wagering game machine 102). Other functionality not directly related to game play may include power management, presentation of advertising, software or firmware updates, system quality or security checks, etc. Any of the wagering game network components (e.g., the wagering game machines 102) can include hardware and machine-readable media including instructions for performing the operations described herein.

Additionally, one or more virtual-reality headsets 103 may be connected to the network via a wireless access point 104. The headsets 103 may alternatively be coupled directly or indirectly to a particular wagering game machine 102, wired or wirelessly, enabling a player to interact with that wagering game machine 102 to play a wagering game. Further, the headsets 103 may communicate with one or more wagering game servers 106 to send information (e.g., audio, video, game imagery, etc.) and receive information (e.g., head/eye/headset orientation, position, selections, etc.) for presenting, conducting, and playing the wagering game (s).

Figure 5:
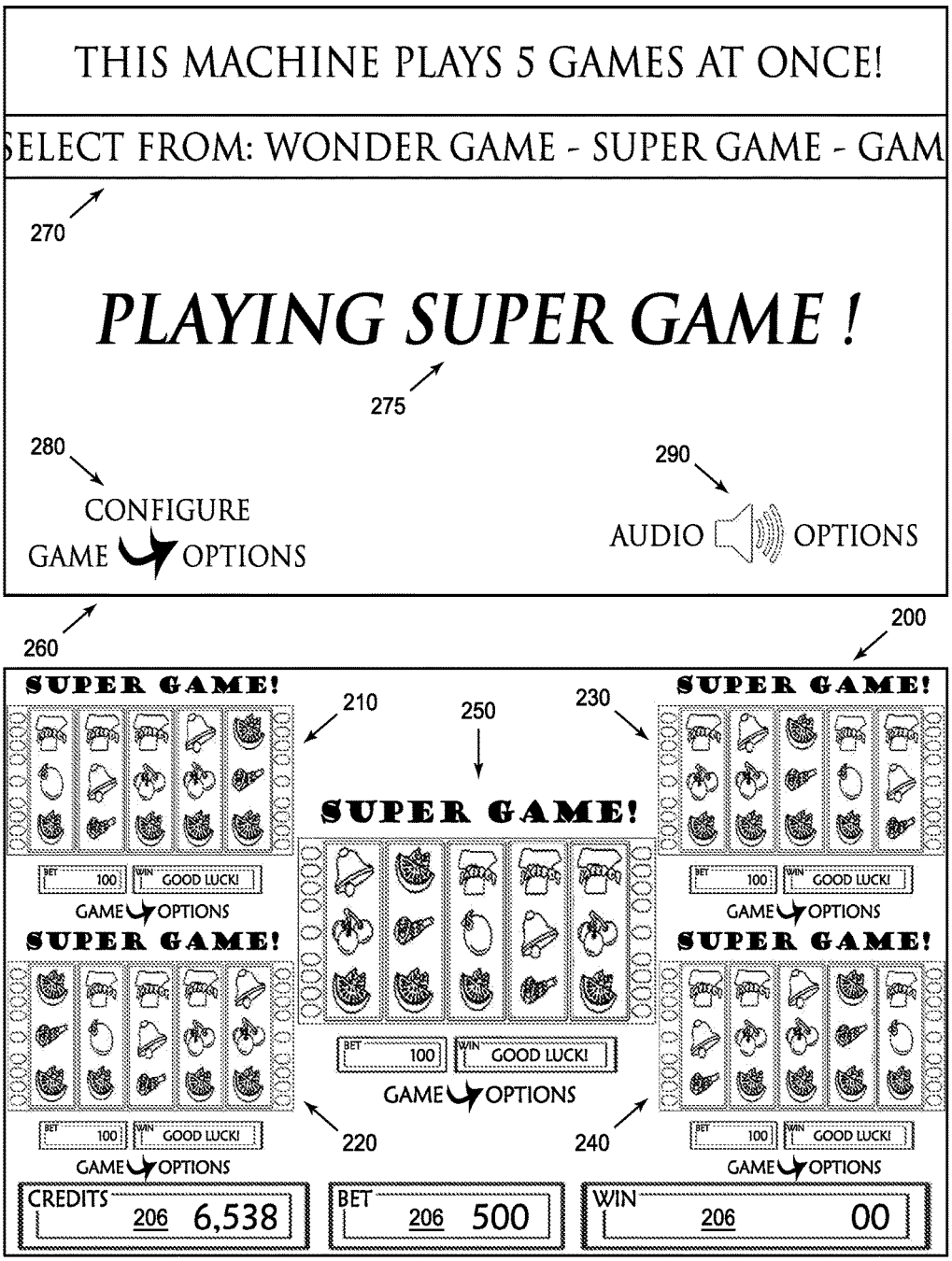
FIG. 5 is an image of an exemplary basic-game screen having concurrent wagering games displayed on a gaming machine, according to an embodiment of the present invention.

Referring now to FIG. 5, a wagering game primary display 200 and a secondary display 260 are shown as a conjunctive graphical user interface in one embodiment for displaying content including concurrently performed wagering games. In one embodiment, the primary display 200 and the secondary display 260 may correspond to the primary display 18 and the secondary display 20, respectively, of gaming machine 10 shown in FIG. 1. In other embodiments, the primary display 200 and secondary display 260 may be separated by a considerable distance, for example, when mounted on different walls of a casino or sportsbook.

The display 200 has five visual presentations 210, 220, 230, 240, and 250, being simultaneously conducted, wherein each visual presentation 210-250 is a separate, concurrently performed wagering game instance. A series of common meters 206 display a set of collective information for the player that is distinct from the individual meters corresponding to a specific one of the visual presentations 210-250. The meters 206 may include, for example, a player credit meter, a total number of credits wagered in all the simultaneous games, and a collective win credit meter, as shown. The meters 206 may additionally or alternatively include other quantitative values such as player tournament points, player reward points, session player reward points earned, session credits spent, session credits won, etc.

In other embodiments, more or fewer visual presentations 210-250 may be simultaneously presented. In yet other embodiments, the visual presentations 210-250 may individually be completely different types of wagering games, including but not limited to video slot games, video poker, baccarat, or blackjack/twenty-one card games, skill-based games, BINGO or KENO-type class II games, etc. Each visual presentation 210-250 may be individually selected and options may be specified for one or many of the visual presentations 210-250.

The secondary display 260 displays information in a number of visual presentations including a scrolling banner 270, a notification field 275, a game configuration menu activator 280, and an audio configuration menu activator 290. The secondary display 260 may comprise any number of any types of the visual presentations 270-290, including but not limited to those shown. The visual presentations 270-290 may include any combination of text, imagery, animation, video, etc., and may even be duplicated from one or more of the visual presentations 210-250 displayed on primary display 200. The visual presentations 270-290 may also have associated audio components that are played or selectively mixed with the audio component output associated with the visual presentations 210-250 during routine operation.

Using various methods, a specific one of the visual presentations 210-250 is determined to be at the center of attention of the player so that one or more highlighting functions for that visual presentation may be achieved. For example, a gaming system (e.g., gaming machine 10) may use embedded, attached, or associated video camera(s) (e.g., cameras 36) that view the player's face, in conjunction with an eye, iris, or gaze-tracking algorithm to make a determination regarding the player's visual focus on the wagering game primary display 200. Using associated coordinate information, it becomes possible to correlate player focus to a specific game presentation 210-290 presented on one or more display devices presenting the graphical user interface displayed by display 200 and display 260. For example, methods and information processing for eye and gaze tracking with the use of video cameras in a wagering game environment is described, inter alia, in U.S. Pat. No. 8,721,427, incorporated herein by reference in its entirety.

In an embodiment, the visual presentations 210-250 are independent and retain the corresponding unique audio assets of each visual presentation. In a multi-game presentation, the audio presented to the player would dominantly be that of the visual presentation where the player is currently focusing their attention. The system is constructed to selectively mix audio from the entirety of visual presentations. Audio related to visual presentations that are not at the center of player focus are diminished or muted. As the focus of the player changes (i.e., the player looks or focuses on a different visual presentation on the one or more displays), the audio output switches to the visual presentation that corresponds to the visual focus of the player.

Further, special events may occur in one or more visual presentations that are outside the current visual focus of the player. For example, a player may be focused on the visual presentation 210 while an important event occurs in the visual presentation 240 (e.g., achieving a "big win" outcome, winning a jackpot or progressive, or triggering a bonus round). In this case, the selective audio mixing may allow the audio associated with the visual presentation 210 to remain dominant and include an auditory cue to alert the player (or draw the player's attention) to the event in the visual presentation 240. The system permits selective mixing of audio components based on region of player focus to provide a unified audio presentation to accompany the unified visual interface.

In addition to audio cues, visual cues on the primary display 200 and the secondary display 260 may further serve to direct or indicate player focus and/or attention to particular visual presentations of the corresponding displays. One or more visual cues may be used to provide a visual indication of the dominant audio source or component to the player and/or observers. This feature may be useful when the primary display 200 performs a set of concurrent multi-games (i.e., where multiply games evaluate/play simultaneously in parallel). In one embodiment, in response to a specific visual presentation 210-290 requiring attention (potentially time-sensitive), the system may force focus by ignoring head and eye positioning information and dimming all areas of the display devices to indicate focus. Other embodiments may use visual features, with or without audio accompaniment, to indicate particular regions that require focus.

Common features implemented to draw or indicate visual attention employed on the displays 200, 260 may include one or more of the visual presentations 210-290 dimming or brightening, highlighting, moving, shaking, flashing, gaining a contrasting outline (e.g., using an outer glow), throbbing/pulsating (e.g., in time with sound), undergoing color shift, enlargement, re-arrangement of ordering, using animations, imparting overlays, one or more three-dimensional effects, or the use of other visual cues. A number of different highlighting methods may be used conjunctively to create an aesthetically pleasing notification of specific area(s) of the display 200.

In a system providing concurrent gaming, a common (or generic) set of input buttons (e.g., buttons 26 and/or virtual buttons 86) of a button panel are often used to provide input to the concurrently operating visual presentations 210-250. Input to various games may initiate bonus game features, or indicate pick field selections, specification and/or confirmation of menu options, card hold/discard selections, wagering options, etc. In many cases, the set of buttons, whether physical or virtual, ultimately cause the generation of electronic signals upon actuation used to report the actuation of a specific button. The electronic signals may be utilized to cause a corresponding effect based on the electronic signal input. The effect of each of the set of buttons may be reported on one or more display devices 200, 260, potentially within the one or more visual presentations 210-290, and be fully dependent upon current player focus.

In some embodiments, the set of buttons of a button panel may further be programmed to take on visual aspects of the function that the button serves when actuated (in respect to the corresponding visual presentation). That is, a button may use light-emitting diodes (LEDs) to display imagery on the button itself indicating the function of the button when pressed. Thus, in response to the system determining a region of player focus of the primary display 200, physical input signals generated by player actuation of button(s) 26 and/or virtual button(s) 86, may then be properly routed to the application instance that the player is currently focused on.

In other embodiments, a visual presentation 210-290 may define a virtual "eye-deck" or "eye-panel" of buttons that can be used to provide input to visual presentations dependent upon current player focus. For example, a virtual set of buttons (e.g., buttons 86, button panel, etc.) may be presented as part of the visual presentation 210 when the player is determined to be focused on a specific region of the primary display 200. The player then may be given the ability to select, using head-tracking, gaze-tracking, physical actuation, or other input indications to make an indicated selection from the buttons or button menu. Examples of such input indications include the player nodding, shifting eyes back and forth, pressing a particular or generalized button, or blinking thrice, to generate a button selection/actuation from a virtual button panel. In response to the player selection, a corresponding electronic signal is generated and used by the system to indicate the button selection for the input prompt, generally dependent upon current player focus.

In combination with the selective mixing of the associate audio components of the visual presentations 210-290, the ability for the system to dynamically determine player focus enables a gaming system to delay processing or execution of an event or gaming feature specific to a particular visual presentation 210-290 until the player has focused attention to a given region. Thus, it becomes possible to greatly impact the player's gaming experience by highlighting exciting events (like winning and/or bonus round triggering and performance in a wagering game) such that exciting or important events are not inadvertently missed, neglected, or ignored, even in the course of other concurrent gaming events. In one embodiment, one or more of the visual presentation 210-250 may cause a bonus event (e.g., spinning a large, virtual wheel) to be triggered and conducted on the secondary display 260. The system is able to delay initiation of the bonus event until the player has focused attention on the secondary display 260. In another embodiment, one or more of the visual presentations 210-250 can be actively paused until the player focus is drawn to a particular region of the primary display 200. For example, consider concurrent wagering gameplay of the visual presentations 210-250 includes simultaneous bonus events in the visual presentations 220, 230, both involving a number of free spins. The system is able to delay initiation, execution, and resolution of the bonus event free spins in both visual presentations 220, 230 until the player is actively engaged with one of the regions of the display 200 displaying the visual presentations 220, 230.

In other embodiments, audio cues and special visual "holding" patterns may be selectively used in the video and audio presentation to the player in accordance with the current player focus. That is, when special events occur in one or more regions of the displays 200, 260 (other than the region with current player focus), various audio and visual renderings may be used to draw player attention to a particular display region. This opportunity can be used to provide entertaining sequences to observers, or provide filler content while events conclude in other parts of the displays 200, 260. Events such as credit "roll ups" (and other common game audio assets) may be played regardless of player visual focus. A common background audio track may also be used in conjunction with one or more unique game instance audio components, based on the current game of focus, playing over or otherwise selectively mixed with the background track.

As player focus shifts between the various visual presentations 210-250, differing methods of selective audio mixing may occur to provide a naturally intuitive auditory flow of sounds perceived by the player. The mixing of audio components of the visual presentation 210-250 may be performed by fading (prior visual presentation audio fades out, new presentation fades in), crossfading (fade in and out occur simultaneously), use of additional audio cues (e.g., uniform transitioning sound), for example. A default audio track or dedicated audio component may be used in the event that player focus of a particular visual presentation 210-250 cannot be determined (e.g., no-gaze detection). Alternatively, the sound component of the prior (or current) visual presentation 210-250 may continue uninterrupted. Further, if a determination is made regarding player focus being directed to a "common" region (e.g., collective meters, menu icon, etc.) or another non-presentation video area, the last used audio component may continue or a replacement audio component may be interjected.

The audio output manipulation may also be performed in response to other events and player focus determinations such as the player fixing gaze upon an upper display device (e.g., screen 20), a side or wing display device, a topper of the game machine 10, or some other region external to the game machine 10. For example, a display component (such as upper screen 20) may be used to scroll a selection of games available for play on the gaming machine 10 or display the set of concurrently display games as shown in display 200. Upon determining the player is focused on this specific display region (of the gaming machine 10 or external display monitor), a determination can be made about the specific game being displayed at the time the player is focused thereon. In response, audio component(s) can be presented to the player (or observer) having game specific audio, audio describing game rules or special features, available jackpots or potential benefits, specific attraction sequences to entice player engagement, related player rewards, etc. For example, when the upper display screen 20 scrolls the available games and the player is detected to have focus thereon, the gaming machine 10 may be programmed to stop and pause the scrolling video content of the upper display 20 and play audio related to that game or theme. The system may also detect people's gaze passively and act as an effective attract mode for passersby.

Determining the region of focus of a player can be performed in a variety of ways. One way to determine player focus (i.e., gaze) may be performed using orientation of the head, orientation of the eyes, or both to determine what sections of the environment or display device(s) the player is directly fixated upon. In one example, one or more cameras are positioned to capture imagery that allows one or more specialized processors to perform image processing and determine, based upon the direction of the gaze of the player (determined, for example, from position of the head and/or eyes), a specific region of player focus. In other examples, a virtual-reality headset may be used to gather, perform, and report, via electronic messages, positional information of one or more sensors and/or region(s) of gaze and player attention while utilizing the headset.

Figure 6:
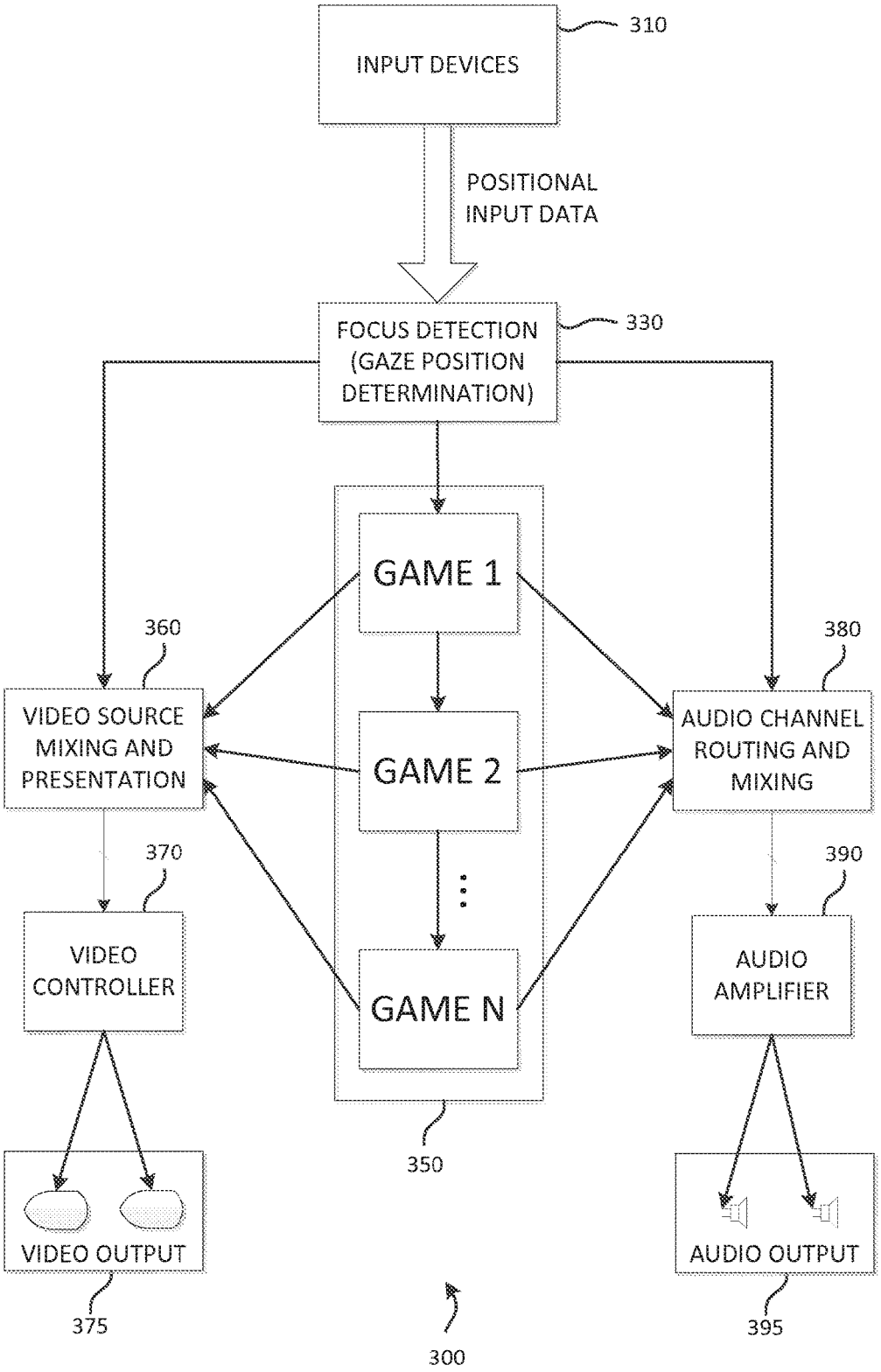
FIG. 6 is a schematic view of components of the input signal and audio processing portion of a wagering gaming system according to an embodiment of the present invention.

Referring now to FIG. 6, a schematic diagram of a gaming system 300 having multiple concurrent wagering game visual presentations having dynamic and selective audio mixing of the visual presentations is described in one embodiment.

The gaming system 300 includes one or more input devices 310, a player-focus detector 330, a set of concurrently performed visual presentations 350, a video mixer 360, a video controller 370, one or more display devices 375, an audio mixer 380, and audio amplifier 390, and one or more audio output devices 395. One or more processors (not specifically shown) receive, generate, and interpret messages related to actions of the input devices 310, perform various data processing functions such as player gaze and focus detection, display of the set of concurrent visual presentations 350, audio mixing, etc. In one embodiment, the concurrent visual presentations 350 are wagering games (GAME 1, GAME 2, . . . , GAME N), each having an associated visual component and a corresponding audio component.

The one or more input devices 310 provide positional input data based on information gathered by various means including inertia-based sensors, internal gyroscopes, rotational and positional tracking, and may include raw imagery that may be processed to determine orientation of the body, head, and/or eyes of a player positioned in the image frame. Using a player-focus detector 330 comprised of one or more processors (e.g., game-logic circuitry 40), an indication of a center of attention (i.e., an area of focus) of the player is generated using positional input information received from the one or more input devices 310. The processors of detector 330 may be a part of an input device (such as a virtual-reality headset), a part of circuitry performing generation of the visual presentations (such as game-logic circuitry 40), or part of an intermediary processing module (such as game server 106). The processing of positional input data occurs intermediate to the input devices that gather the position input information and the display devices that display the visual presentations 350. The processors of the detector 330 may either passively obtain and gather positional input data generated by the input devices, or actively determine positional input data to determine the player center of attention and focal point.

The audio mixer 380 and the video mixer 360 receive this player focus indication from the detector 330 to discern how the visual presentations 350 will display, how input information from the input devices 310 are routed, and how the audio signals from the visual presentations 350 will be processed and selectively mixed by the audio mixer 380 to be output on audio output devices 395.

In one embodiment, the collection of video components of the visual presentations 350 are formatted and merged into visual output by the video mixer 360, generating one or more video streams to be rendered using the video output devices 375. The video controller 370 may structure the video into a required format for display, for example, having a defined image/screen size, resolution, and refresh rate to format the video for the particular output device(s) 375. Each video output device 375 (e.g., monitor) may render a single video stream, where each video stream may comprise a merging of multiple other streams generated by the visual presentation 350 and assembled by the video mixer 360. In some embodiments, the video controller 370 generates visuals for a virtual-reality environment interface that is displayed on multiple output devices 375 that are simultaneously viewed by the player to create a single perceived three dimensional image.

In an embodiment where a merging of the video outputs do not occur (e.g., in a sportsbook casino environment having display monitors positioned throughout the establishment), the video mixer 360 may not perform processing functions beyond forwarding the incoming video streams to the proper video output device 375 via the one or more dedicated video controllers 370. Further, any communication from the detector 330 to the video mixer 360 may be completely absent in an environment where the player gaze does not impact the output of the video output devices 375.

The collection of audio components of the visual presentations 350 are selectively routed and mixed by audio mixer 380 to generate a set of channels of audio data to be played using the audio output devices 395 via audio amplifier 390. Each audio output device 395 (e.g., speaker) typically renders a single audio channel, where each audio channel may comprise multiple other channels mixed together by audio mixer 380. Thus, the audio channel information generated by audio mixer 380 is typically presented to the player using a corresponding number of the output devices 395.

The audio mixer 380 is also able to generate a three-dimensional spatialized audio field uses relative positioning to generate sounds corresponding to positioning of the presented visual presentations 350. For example, a visual presentation positioned in the upper left of the interface generated by video output devices 375 would result in sounds coming from the "upper left" section of the audio field. This allows audio to be selectively generated in relative accordance with how and where the visual presentations 350 are presented.

The player-focus detector 330 may receive positional (and other) input information from a variety of sources and process the received information to derive a corresponding region of focus of the player of the visual presentations by determining where the player's gaze is directed. Some examples of devices that provide positional input data relating to the determined visual perception of the player (relative to the visual output devices and visual presentations 350) may include camera(s) (providing image data that is processed to determine head position and orientation, eye position and orientation, and/or gaze detection). A number of head-position and eye-position tracking algorithms currently exist that may be used to derive a region of gaze/focus detection relative to the display device(s) and visual presentations 350.

One or more cameras may be mounted proximal to the player position (e.g., gaming machine 102), integrated within a contained player position (e.g., part of an audio chair or enclosed gaming machine 102), and/or remotely observing the player position from a fixed position. Additional cameras permit additional visual information to be gathered to allow collective image or video processing by the detector 330 to more accurately generate a region of interest or attention of an engaged player.

Another type of device for generating positional input data includes a virtual-reality headset, for example, headset 103. The headset 103 provides precise positional information related directly to head-positioning, eye-positioning, and head/eye movement tracking directly measured relative to the display device(s) displaying the visual presentations 350. In one embodiment, the headset 103 has a pair of integrated display devices 375 that provides a virtual environment for display of many of the visual presentations 350 simultaneously. A set of integrated headphones (audio output devices 395) to present coordinated audio may also be present. A significant benefit to using the headset 103 as a positional-data input device is the incorporation of (at least part of) the detector 330 into the headset 103. The imagery of the visual presentations 350 are provided to the headset 103 for rendering while head and eye positional information may be immediately sensed based upon the positional input information and relative placement of the visual presentations 350. The positional input information is processed by the gaze detector 330 and the results of the focus detection is delivered to one or more processing units of the gaming machine (e.g., game-logic circuitry 40) for button input processing and routing, video source merging and formatting, and selective audio mixing by audio mixer 380 for continuous audio to the audio output devices 395. This creates a continuous feedback loop of audio and visual content and positional input information that are correlated directly to the focal attention of the player. As player focus changes to different regions of the visual presentations 350, the player focus is updated by detector 330, the audio and video components of the visual presentations 350 are merged, formatted, and are selectively mixed by the audio mixer 380 and the video mixer 360, respectively, and the output is rendered by the audio output devices 395 and the video output devices 375, and the process repeats.

The algorithms performed by the detector 330 may be dependent upon the type of positional information being provided by the one or more input devices. For example, head-position data processing algorithms (i.e., head-tracking) may require positional information that detects head position relative to the one or more display devices providing the visual presentations 350. Other types of data-processing algorithms may include a variety of eye-tracking and head-tracking software and hardware capable of accurately deriving a region of the display devices where a player is maintaining current visual focus.

In one embodiment, a player is positioned in a chair positioned in a sportsbook environment having visual access to a number of display devices positioned throughout the sportsbook establishment. The chair is equipped with embedded audio speakers delivering audio to the player. A plurality of cameras is positioned to observe the player within the confines of the chair. The cameras provide imagery used to derive positional information of the player's head and eyes to determine a region of visual attention of the player. The speakers in the chair provide sound that relates directly (or solely) to the audio component of the visual presentation corresponding to the player's region of focus/attention. For example, the visual presentation determined to be in the player's focus will have a dominant audio component as perceived by the player in the chair. That is, all the other audio components of all the other visual presentations may be completely muted or selectively mixed in such a way the visual presentation corresponding to the player's focus is dominant. As the player's focus of attention shifts to another visual presentation, the dominant audio component rendered through the speakers of the chair changes accordingly.

In one embodiment, the detector 330 is also equipped to detect various predefined motions of the head and/or eyes that can initiate input signals that can cause context-based menus to be displayed and selections from the menus to be made without manual button or device actuation. That is, the system is configured to detect, from tracked motions, positioning, or sequences of motions of the perceived player's head and/or eyes, that a context-based menu should be displayed (relating to the visual presentation in focus) and the subsequent selection of one of the menu options should also occur. Both these functions are independent and may occur separately or in conjunction.

In one embodiment, the detector 330 is configured to utilize the received positional input information to determine that the player is not currently focused on the current game (e.g., when an important event is occurring or will occur) and uses triggered events to draw the player's attention back to the current game to witness the important event. Events to recall or force attention may include audio events (e.g., using 360-degree audio perception to indicate directionality), use of embedded transducers to generate physical feedback about the game state in games equipped with a sound chair, or even a mobile device using embedded haptic feedback.

Various configurations for audio output as generated by the audio mixer 380 are possible. In one embodiment, generation for dual-channel stereo headphones may be sent to a virtual-reality headset (e.g., headset 103) having such audio capabilities. In other embodiments, the audio output devices 395 are modularly distinct from all other equipment. For example, a set of two audio output devices 395 (i.e., speakers) may be modularly mounted in or on a chair positioned in a sportsbook casino environment or delivered through a pair of headphones. In yet another embodiment, a set of speakers may create a three-dimensional sound field around a particular wagering game machine 102 on a casino floor. In yet another embodiment, the audio may be delivered wirelessly (e.g., Wi-Fi, Bluetooth, etc.) to one or more participating observers or remote speakers proximal to the player, possibly stereo headphones.

An embodiment that utilizes stereo headphones as the audio output devices 395 (or alternatively, plural audio output devices 395 positioned to create a full or virtual sound field for the player), may create three-dimensional sound that may exhibit directionality of the source of an audio source in a virtual environment. For example, a player surrounded by visual presentations 350 on a set of encircling display devices in a sportsbook casino setting may be watching (and exclusively listening) to a baseball game occurring on one of the display devices. The player has a number of outstanding wagers on a number of visual presentations 350 concurrently being conducted and displayed on the multiple display devices. In response to the final score being determined (and posted) for a game that the player has wagered on (i.e., a visual presentation 350 displayed on a different monitor), the system may play a sound that corresponds to the relative direction of the monitor so the player may be alerted to new available information and shift attention accordingly. The directionality of the audio sound provides a way for a player to be directed to a display device (or region of a display device) without any additional content and required processing by the alerted player. Considering an example using a headset 103, audio directionality may be used to alert the player to events and time-sensitive selections in different visual presentations by using audio that does not disrupt the visual presentation the player is actively paying attention to.

Surround sound can be created electronically in several ways including processing the audio source(s) with psychoacoustic sound localization methods to simulate a multi-dimensional sound field using headphones (for example, of a headset 103). The generated multi-dimensional audio may be rendered additionally on audio equipment having multiple speakers, for example, a five-point-one (5.1) surround sound multichannel audio setup including five or six encircling speakers: a front left and right speaker, a center channel speaker, two surround channel speakers, and an optional subwoofer. Any greater number of speakers may be used to increase the effectiveness of the surround sound audio ultimately delivered to the player.

Alternatively or additionally, a three-dimensional (3D) audio effect can be generated to manipulate sound produced by a set of stereo speakers, surround-sound speakers, speaker-arrays, or headphones, generating the placement of sound sources in a virtual three-dimensional space, including behind, above, or below the listener. Other types of 3D audio rendering include recording or generating binaural sound (emulating sound as received by a set of ears) or real-time multiple-zone 3D sound generation.

Referring now to FIG. 7A, a virtual-reality environment used to generate a virtual-reality interface 400 is shown in one embodiment. In one embodiment, virtual-reality interface 400 visually and audibly presents a user interface to a player that includes a plurality of visual presentations concurrently in a computer generated virtual reality. The virtual-reality interface 400 comprises a primary (in focus) visual presentation 410, a set of multiple secondary (out of focus) visual presentations 420, and a set of tertiary visual presentations 430 indicating a need for user interaction and/or input. The player current region of visual focus (designated by the trajectory of the camera icon 490) is determined using the positional input data reported from one or more input devices (e.g. headset 103). The determination of the player region of visual focus may be performed by the same logic circuitry performing one or more of the visual presentations 410-430, or performed by a separate processing unit (e.g., headset 103 or another intermediate processing module, not shown).

The one or more input devices are configured to generate positional input related to a determined visual perception of the player. The positional input is determined relative to the one or more visual output devices. As the position of the player's head, eyes, or perception shifts, the trajectory of icon 490 will change accordingly and can be numerically derived from the positional input data reported by the one or more input devices. As discussed prior, the positional input data relates to the region of player visual perception relative to the one or more visual output devices displaying the interface 400. Thus, one or more processors receive the positional input from the input device(s), determine a center of attention of the player from the positional input (for example, by determining what region of the virtual-reality display presentation corresponds to the orientation of the headset), and a primary visual presentation 410 is designated from the plurality of visual presentations 410-430 corresponding to the center of attention (i.e., screen region) of the player. In one embodiment, the headset 103 tracks location in the virtual world environment that the user is looking and updates the interface 400 display accordingly.

The tertiary visual presentations 430 are highlighted to indicate that the player's attention (or specific input) is specifically required (for example, for processing of the presentation to continue). In one embodiment, the tertiary visual presentations 430 may be designed to attract player attention in response to a particular set of events using one or more methods detailed prior. The interface 400 may be designed to delay display and/or processing events or occurrences of the one or more visual presentations 430 until player attention is obtained. In other embodiments, the processing of the visual presentations 430 may continue on a specific timeline (e.g., as in during a game of live poker). The highlighting of the visual presentation(s) may actively take place, for example, audibly and/or graphically, and may continue until an expiration timer lapses or some other event occurs. Preferably, the interface 400 displays information regarding the importance, imperativeness, condition, and/or requirement of the visual presentation 430 awaiting focus to inform the player accordingly.

Highlighting of the visual presentations 410-430 may include a wide variety of methods to attract attention. For example, visual presentations 430 being dimmed or brightened, moved, shaken, flashed, outlined, color shifted, enlarged, re-arranged, animated, overlaid, etc.

The visual presentations 410-430 may be generated from a distinct set of received video streams, where each video stream has an associated, corresponding audio component. The number of video streams and visual presentations 410-430 is not restricted to a specific number or arrangement. In one embodiment, all the visual presentations 410-430 are continuously updated, with one of the video streams corresponding to the primary visual presentation 410 rendered on the display, larger and centered.

The audio components that correspond to the plurality of visual presentations are selectively mixed in accordance with the region of focus of the player's attention. The audio component of the primary visual presentation is rendered dominantly on the one or more audio output devices. In one embodiment, all of the audio components associated with the display of the secondary visual presentations 420 and the secondary visual presentations 430 are muted, and the audio presentation of the visual presentation 410 is the only audio perceived by the player. In another embodiment, the volume of the secondary visual presentations 420 and the tertiary visual presentations 430 are reduced so that the audio component of the primary visual presentation 410 is dominant when the combined audio is played.

Referring now to FIG. 7B, a virtual-reality interface 400, as perceived by the player during observation of the virtual reality, is shown for one embodiment. In this embodiment, the primary visual presentation 410 is orientated to the center of the display device while the remaining secondary visual presentations 420 and tertiary visual presentations 430 are arranged peripheral to the primary visual presentation 410. Each of the secondary visual presentations 420 and tertiary visual presentations 430 remain partially visible so that determination of player gaze or attention may be detected and correlated to enable transition of one of the secondary visual presentations 420 or tertiary visual presentations 430 to primary visual presentation 410.

Any arrangement and visual highlighting and marking of the visual presentations 410-430 may be used without departing from the spirit and scope of the invention. The visual presentations 430 that are indicating a necessity of interaction with the player exhibit a heavy border and may be accompanied by one or more (additional) audio components associated with the visual presentations 430 or associated with the event(s) that are occurring that require player interaction (e.g., bonus round initiation, game results reporting, coin meter incrementing, etc.). In the event that a corresponding audio component is muted, a dedicated sound may be used to alert the player and highlight the given visual presentation. Alternatively, any type of highlighting of a tertiary visual presentation 430 may occur to suitably attract attention from the player, and various audio components may be rendered for the player to hear, as discussed prior, either as part of the corresponding audio component of the primary visual presentation 410 or as an additional sound played over the current audio.

In another embodiment, the audio that is perceived by the player is a computer generated three-dimensional audio field that contains sounds corresponding to the relative positioning of the visual presentations 410-430. For example, one or more processors can perform a three-dimensional audio effect and present a positional audio component of the visual presentation 410-430 on the one or more audio output devices corresponding to the relative positioning of the visual presentation 410-430 on the output devices. Thus, a secondary visual presentation 420 positioned in the upper left of the interface 400 would result in sounds coming from the "upper left" section of the audio field. This allows audio to be selectively generated in relative accordance with how and where the visual presentations 410-430 are presented.

In response to the player focusing on one of the visual presentations 430, the visual presentation 430 that is at the center of the player's attention may become the primary visual presentation 410 such that audio may be accordingly adjusted and input received from one or more input devices may be routed to the proper presentation process. This transition may include the rearrangement of the visual presentations 410-430. The primary visual presentation 410, whether situated in the center of the screen or otherwise, is generally visually dominant (or at least evident) such that the primary visual presentation 410 is clearly indicated as the receiver of input information.

Referring now to FIG. 8A, a virtual-reality environment used to generate a virtual-reality interface 500 is shown in a sportsbook wagering embodiment. Typically a virtual-reality interface 500 of this type is displayed using a virtual-reality headset (e.g., headset 103), but may be achieved using other presentation methods such as hologram projection, 3D television/movie technology, perspective projected display, etc. Similar to FIG. 7A, the virtual-reality interface 500 is shown comprising a primary visual presentation 510 (currently in player focus) and multiple secondary visual presentations 520 (currently out of player focus). The interface 500 may be presented to the player using a headset 103 that also includes the display device(s) providing the visual presentations 510-520 to the player and provides positional input information to a processor (e.g., detector 330).

Alternatively, the arrangement of the visual presentations 510-520 in the interface 500 may be much different, for example, having the primary visual presentation 510 positioned in another location other than the center of the interface 500. The visual presentations 510, 520 are generated from a distinct set of received video streams, where each video stream has an associated audio component. The number of video streams and visual presentations 520 is not restricted to a specific number or arrangement.

In another type of sportsbook environment, the visual presentations 510, 520 may be presented on separate monitors positioned about the walls and surfaces of a casino or wagering bar. In this embodiment, player positional input information to determine player focus may be achieved by a headset 103 (if present), one or more fixed-position cameras in the establishment, a mobile device implemented by the player, one or more cameras integrated into a sound chair delivering audio to the player, etc. As discussed prior, the positional input information relates to the region of player visual perception relative to the one or more visual output devices used to determine one of the visual presentations 510, 520 as the primary visual presentation 510. Alternatively, the specific primary visual presentation 510 may be manually selected or designated by the player by use of one or more input devices, for example, a pointing device.

In response to determining a primary visual presentation 510 corresponding to the player's region of focus (e.g., using the detector 330), the audio mixer 380 selectively mixes the audio streams of the visual presentations 510, 520 together such that the audio component of the primary visual presentation 510 is dominant. In one embodiment, the audio component of the primary visual presentation 510 is the only audio rendered and delivered to the player (i.e., the audio components of the non-primary visual presentations 520 are muted), but any suitable mixing may occur that maintains some or all of the audio information associated with one or all of the visual presentations 520. For example, a diminishing or reduction in volume of all audio components except the audio component of the primary visual presentation 510 is performed while all audio components are rendered simultaneously. Audio assets corresponding to predetermined events that occur in the visual presentations 510, 520 may also be incorporated into the audio output.

Referring to FIG. 8B, after the primary visual presentation 510 is determined, the interface 500 may be designed to include a context-sensitive menu 550 containing wagering (or other) options corresponding to the primary visual presentation 510. The context-sensitive menu 550 may be integrated into the virtual-reality interface 500 at generation or alternatively be generated and displayed as an overlay to an underlying interface 500. The context-sensitive menu 550 may be displayed in response to one or more input devices, for example a manual actuation of one or more physical buttons, the use of one or more other input devices, and/or the recognition of a predetermined gesture or received input as detailed prior.

In one embodiment, the context-sensitive menu 550 provides a way for the player to interact with the primary visual presentation 510 using a specialized menu particular to the primary visual presentation 510. As shown, the menu 550 provides a list of wagering options that a player may make corresponding to the sporting event taking place in visual presentation 510. The menu 550 may (additionally or alternatively) include options specifically relating to the establishment in which the system is implemented, such as reporting player's points, ordering specialty drinks, selections of notification of special events, etc.

Figure 9A:
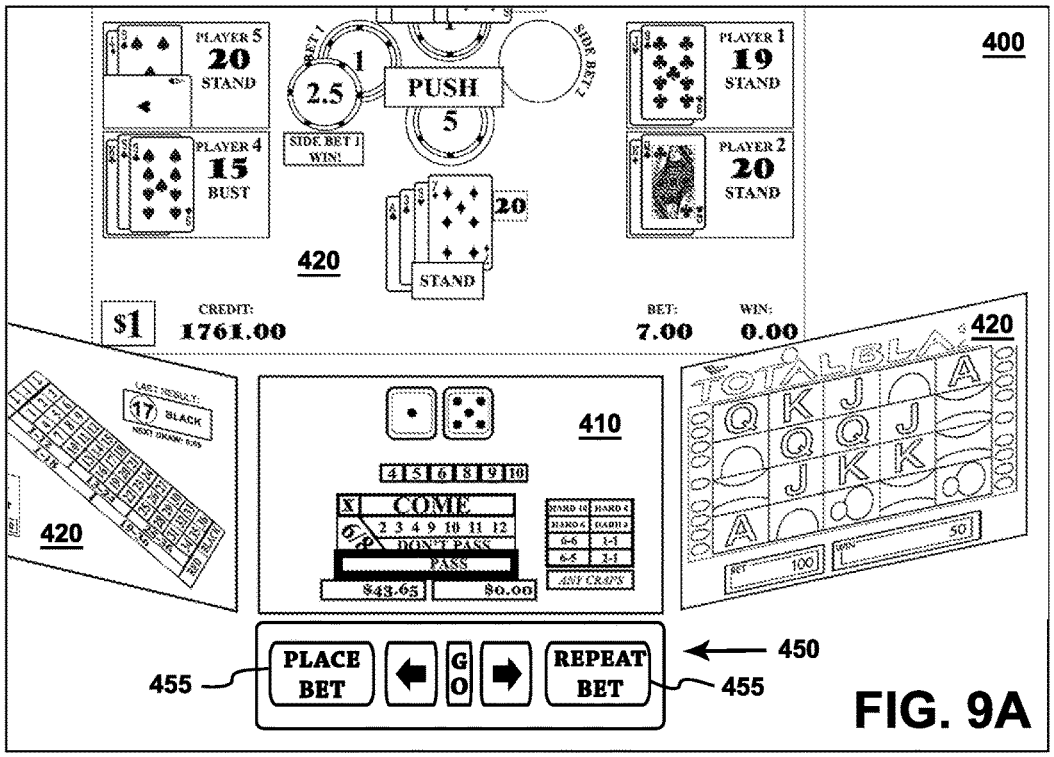
FIG. 9A is an image of a virtual-reality concurrent-gaming player interface having a contextual menu for wagering options, according to an embodiment of the present invention.

Referring to FIG. 9A, a virtual-reality interface 400 is shown providing a context-sensitive menu 450 that corresponds to the wagering game displayed in the primary visual presentation 410 in one embodiment. The context-sensitive menu 450 comprises a number of virtual buttons 455 (sometimes referred to as an "eye-bank") in the virtual interface 400. The virtual buttons 455 may correspond to a bank of physical buttons on a wagering machine (e.g., machine 10), a section of a bank of virtual buttons, or a set of input messages that are generated upon selection of the one or more buttons (either physical and/or virtual) that may be processed to cause a desired effect. For example, a set of generic physical buttons 26 on a gaming machine 10, a set of virtual buttons 86 on an interface of the machine 10, or a set of virtual buttons 455 on the virtual-reality interface 450, may be used by the player to generate a corresponding input message that dictates the selections of options and amounts for selecting wagers or wagering options, initiating wagering games, inputting funds, cashing out, etc. The player may provide input to the system using any available input method interchangeably. In this embodiment, the context-sensitive menu 450 provides a way for the player to specify wagers and corresponding amounts specifically for the current primary visual presentation 410.

Figure 9B:
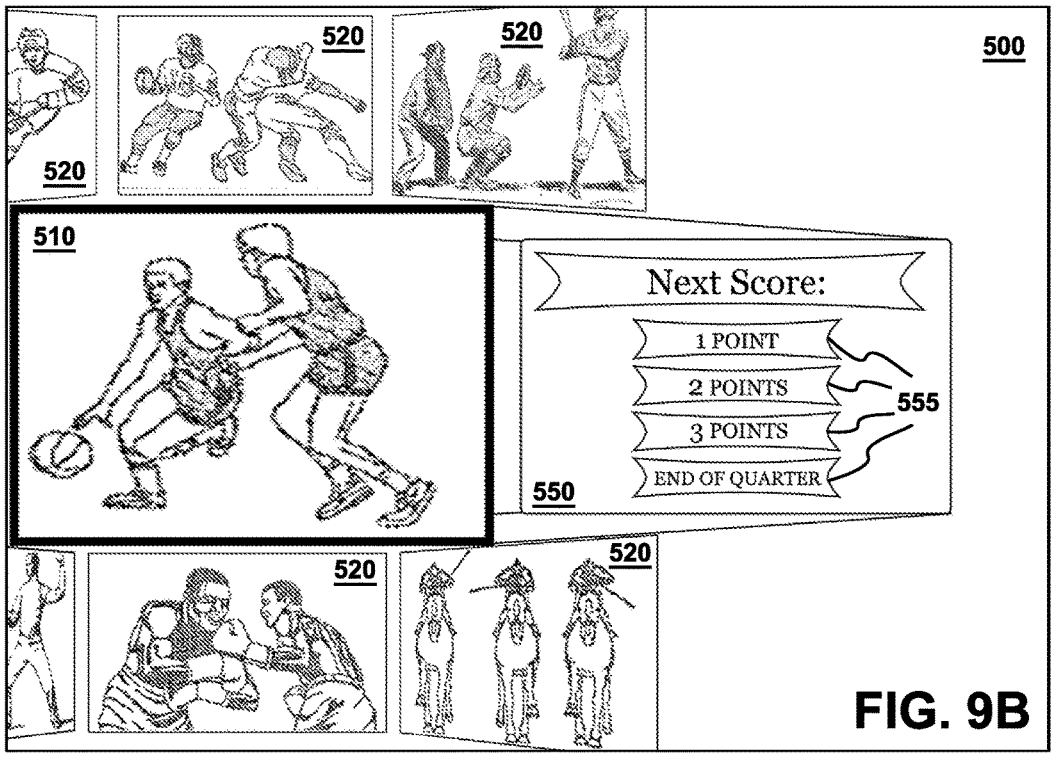
FIG. 9B is an image of a virtual-reality concurrent-gaming player interface in a sportsbook casino environment having a contextual menu for wagering options, according to an embodiment of the present invention.

Referring to FIG. 9B, a virtual-reality interface 500 in a sportsbook environment is shown providing a context-sensitive menu 550 corresponding to the wagering game displayed in the primary visual presentation 510 in one embodiment. The context-sensitive menu 550 includes virtual buttons 555 for the player to make selections for wagers relating directly to the sporting event taking place in the primary visual presentation 510. In this embodiment, the context-sensitive menu 550 enables a player to wager on the outcome of the "Next Score" of the current scoring play of a displayed basketball game. One or more other following screens for the context-sensitive menu 550 may be used to specify an amount to wager, or as in this case, a default value is set by the user and the wager occurs in response to a single selection of one or more of the buttons 555 of the context-sensitive menu 550.

The options of the menu 450, 550 provide a set of shown options in FIGS. 8B and 9B that are specifically non-limiting; any kind of virtual input mechanisms or buttons 455, 555 may be used to get input from the player and gather specified selections without departing from the spirit or scope of the invention. Further, the positioning of the menu 550 in relation to the visual presentation 510 may be modified to accommodate different interface 500 types, styles, and objectives. For example, the primary visual presentation 510 and menu 550 may be centered on the display of the interface 500 as selection takes place having the primary visual presentation 510 return to center after the menu 550 is closed.

The actuation or selection of the virtual buttons 555 may occur as a result of actuating a physical button (e.g., button 26, 86), or may be a result of a recognition of a defined set of motions and/or gestures of the player, player's body, player's head or eyes, or another input device such as a joystick or pointing device. In response to player selection of one or more of the selections of the menu 550, corresponding messages are generated that cause electronic signals and/or messages to be generated in response, processing to occur (e.g. by game-logic circuitry 40), and a result of the player designated action to occur. The primary visual presentation 510, the context-sensitive menu 550, and/or the interface 500 may be updated to report the effect of the player input.

Referring now to FIGS. 10A-10E, a set of modular data processing functions are defined to manage the visual (and accompanying audio) presentations 410-430 during presentation on the interface 400 in one embodiment. A dwell timer variable (DWELL_TIMER) is used to describe the length of time of visual focus of the player on a specific visual presentation 410-430. After a predefined threshold for the dwell time (DWELL_MAX) is exceeded, the visual presentation 410-430 having the current visual focus of the player becomes the primary visual presentation 410. In response, the associated audio component(s) will be presented to the player through one or more audio output devices (e.g., speakers 22). That is, in response to receiving similar positional input from one or more input devices for a duration exceeding a predefined dwell time, the center of attention of the player is determined by one or more processors to designate the primary visual presentation 410.

The dwell time threshold may be a fixed time (e.g., one second) or be an adaptive time based on the age of the player. In one embodiment, the age of the player may be estimated or determined by the information gathered from a camera associated with the wagering game (e.g., cameras 36), or alternatively be digitally retrieved from a central or remote database storing profile information of the player. This permits the system to adapt to various players and providing a longer dwell time for players having a specified preference or a default for older players to compensate for diminished perceptual acuity.

In one embodiment, as a secondary visual presentation 420 or tertiary visual presentation 430 becomes focused on, a dwell timer begins to count down (decrement). Alternative embodiments may use a counting-up (or time incrementing) methodology. Once sufficient dwell time has been achieved (i.e., the dwell timer reached a predetermined threshold), it may be determined that the player is currently focused on a particular secondary visual presentation 420, for example. The primary (center) visual presentation 410 is switched to the content from the secondary visual presentation 420 (the secondary visual presentation 420 is transitioned to become the primary visual presentation 410), and the audio is transitioned between the prior presentation's audio component and the audio component associated with the new center presentation.

As detailed prior, selective audio mixing of the audio components may take place including, audio fade-out (of the previous visual presentation) and audio fade-in of the new presentation, audio cross mixing as audio transitions from one presentation to the next, additional audio cues to signal to the player of game switching, visual cues of the current visual presentation the player is focused on, a common background audio track mixed with unique presentation instances based on focus, etc. Regardless of the player's current focus, the system retains the ability to mix additional audio asset components for special events (e.g., bonus events, big win hits, coin meter incrementing, etc.) that may occur in a visual presentation 410-430. Additional visual cues to indicate one or more visual presentations 410-430 may accompany an additional audio asset component, even if the visual presentation is not currently in focus by the player. For example, events such as credit incrementing "roll-ups" and other common presentation audio assets may be played regardless of the player's visual focus. That is, in response to a predetermined event occurring in one of the visual presentations 410-430, the primary audio component may be modified to include an additional audio asset corresponding to the predetermined event in addition to the visual presentation including one or more video-based effects corresponding to the event.

A default audio track may be used in the event of no focus detection, or using the last known presentation audio components when player attention is drawn to an area that does not correspond to one of the visual presentations 410-430 (e.g., common meters 206, banner 270, configuration menus, etc.). Other types of audio manipulation may also occur, including the reduction or muting of visual presentation audio components when out-of-focus. Further, an underlying audio component (not related to any of the visual presentations) may be continuously presented or presented only when no player focus is determined. In another embodiment, where concurrent gaming utilizes a shared gaming table, a large shared game display, and/or a player residing at a dedicated terminal, the game audio presented at a specific player location could be tailored to a region on the main shared display that the player is currently focused. In one embodiment, the player at a specific terminal would only hear audio from the visual presentation presently in focus, for example in a sportsbook environment.

FIGS. 10A-10E describes a set of data processing functions that are attached to each presentation object (e.g., secondary visual presentation 420 in the virtual-reality interface 400) in one embodiment. These functions may be triggered on events occurring (e.g., a particular visual presentation 410-430 being determined as the focus of the player and designated the primary visual presentation 410, a visual presentation 410-430 concluding, etc.), and may use a set of associated variables to track the process of managing the presentation objects and associated audio components.

Figure 10A:
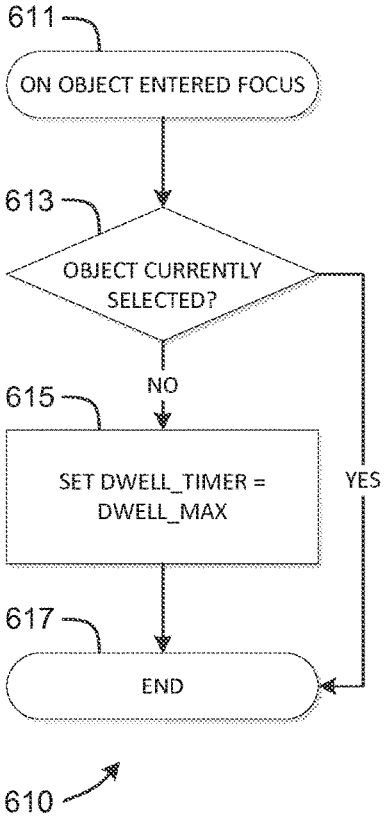
FIG. 10A is a flowchart for a data processing method performed in response to a visual object entering a region of the player visual focus, according to an embodiment of the present invention.

Referring now to FIG. 10A, a process 610 for setting the dwell timer variable in response to a particular presentation object entering initial focus of the player is described in one embodiment. The process 610 begins as a particular presentation object is determined to be at the center of attention of a player (i.e., being currently observed, but not necessarily in-focus) in step 611. In one embodiment, this occurs as a result of the detector 330 determining the current gaze of the player derived from the positional input information received from one or more input devices, e.g., cameras 36 and/or headsets 103.

In step 613, a determination is made as to whether the presentation object being at the current center of attention has been selected. Selection of a presentation object may occur as a result of input from a player (e.g., button actuation or manual cursor manipulation), system determination of an elapsed dwell timer (indicating player focus of attention), recognized predetermined gesture or positional input data, etc.

In step 615, if it is determined that the presentation object is not currently selected, the DWELL_TIMER variable is set to the dwell threshold value, DWELL_MAX. This threshold will be used to determine the presentation object of (current) player focus in future presentation object updates.

In step 617, if the presentation object is currently selected or the DWELL_TIMER variable has been successfully set to the dwell time threshold, the function ends.

Figure 10B:
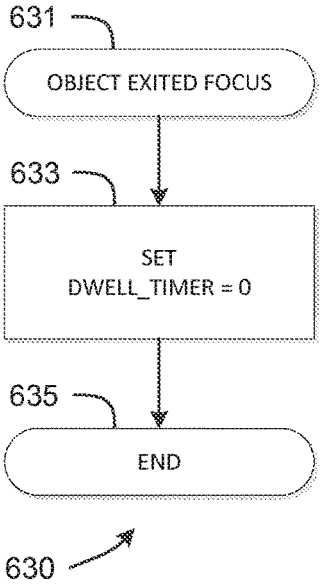
FIG. 10B is a flowchart for a data processing method performed in response to a visual object exiting a region of the player visual focus, according to an embodiment of the present invention.

Referring now to FIG. 10B, a process 630 for setting the dwell timer variable in response to a presentation object exiting focus of the player is described in one embodiment. In step 631, the process 630 begins in relation to a presentation object that has just exited player focus. In step 633, the dwell timer variable is set to zero (since this object is no longer in a region of focus). The process ends with step 635.

Figure 10C:
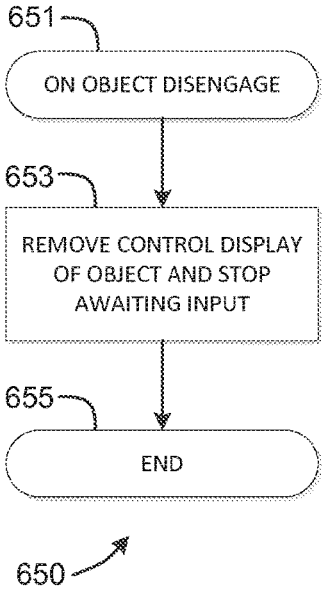
FIG. 10C is a flowchart for a data processing method performed in response to a visual object being disengaged from a region of the player visual focus, according to an embodiment of the present invention.

Referring now to FIG. 10C, a process 650 for disengaging a given presentation object is described in one embodiment. For example, if a visual presentation 520 is terminated (e.g., end of sporting event), the presentation object is disengaged from the display and the player experience as the display of the visual presentation 520 terminates on the interface 500. In step 651, the process 650 begins when reception of a message indicating disengagement of a presentation object is received. In step 653, the presentation object is removed from the display interface (e.g., interface 400, 500) and any process initiated or engaged to interpret, receive, or process input for the presentation object is terminated. The process 650 ends in step 655.

Figure 10D:
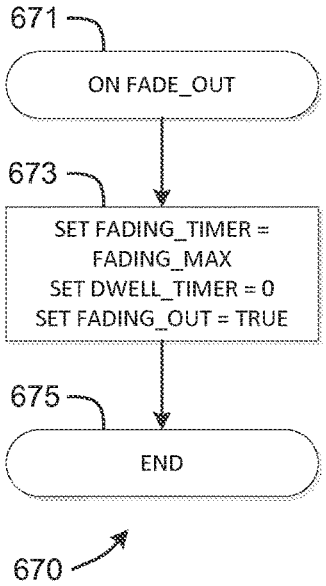
FIG. 10D is a flowchart for a data processing method performed in response to fading the audio component of a visual object, according to an embodiment of the present invention.

Referring now to FIG. 10D, a process 670 for setting various timers in response to a presentation object fading-out of focus of the player is described in one embodiment. In step 671, the process 670 begins for a given presentation object designated to fade out of active player focus. This process will be initiated, for example, when a different presentation object is determined to be in the player focus for a period of time exceeding the dwell timer threshold.

A number of variables are populated with values used to process future events of player focus and presentation object processing. A timer (FADING_TIMER) is used to measure time duration of audio fading and may be used to determine a fractional proportion of the fading process (FADE_VALUE) for adjusting the audio level. The value of this proportion is derived to describe the progress of the fading process, both fading-in and fading-out. A fading threshold value (FADING_MAX) is compared with the current value of the fading timer to determine the proportional value of the timer. For example, fading-in and fading-out each may take a total of two seconds. Thus, when a presentation object begins a fading-out process, the fading threshold value is set to two, and the fading timer counts down from two until the fading timer is zero (or lower) causing the presentation object to be completely faded (FADE_VALUE=1). A presentation object may have a FADE_VALUE indicating the presentation object is not in the player's region of focused attention. Additionally, a set of binary BOOLEAN variables are used to specify whether a presentation object is fading-in or fading-out, FADING_IN and FADING_OUT, respectively. BOOLEAN variables are designed to have one of two distinct values, TRUE or FALSE. In the event that both FADING_IN and FADING_OUT are FALSE for the presentation object, the presentation object is neither fading-in, nor fading-out.

In step 673, in response to a determination that the presentation object is beginning to fade out (i.e., a fade-out process is specified for the presentation object), the fading timer is set to the fading threshold value (FADING_TIMER=FADING_MAX), the dwell timer value is set to zero (DWELL_TIMER=0), and FADING_OUT is set to TRUE.

In step 675, the presentation object fading-out of focus initiation process 670 terminates.

Figure 10E:
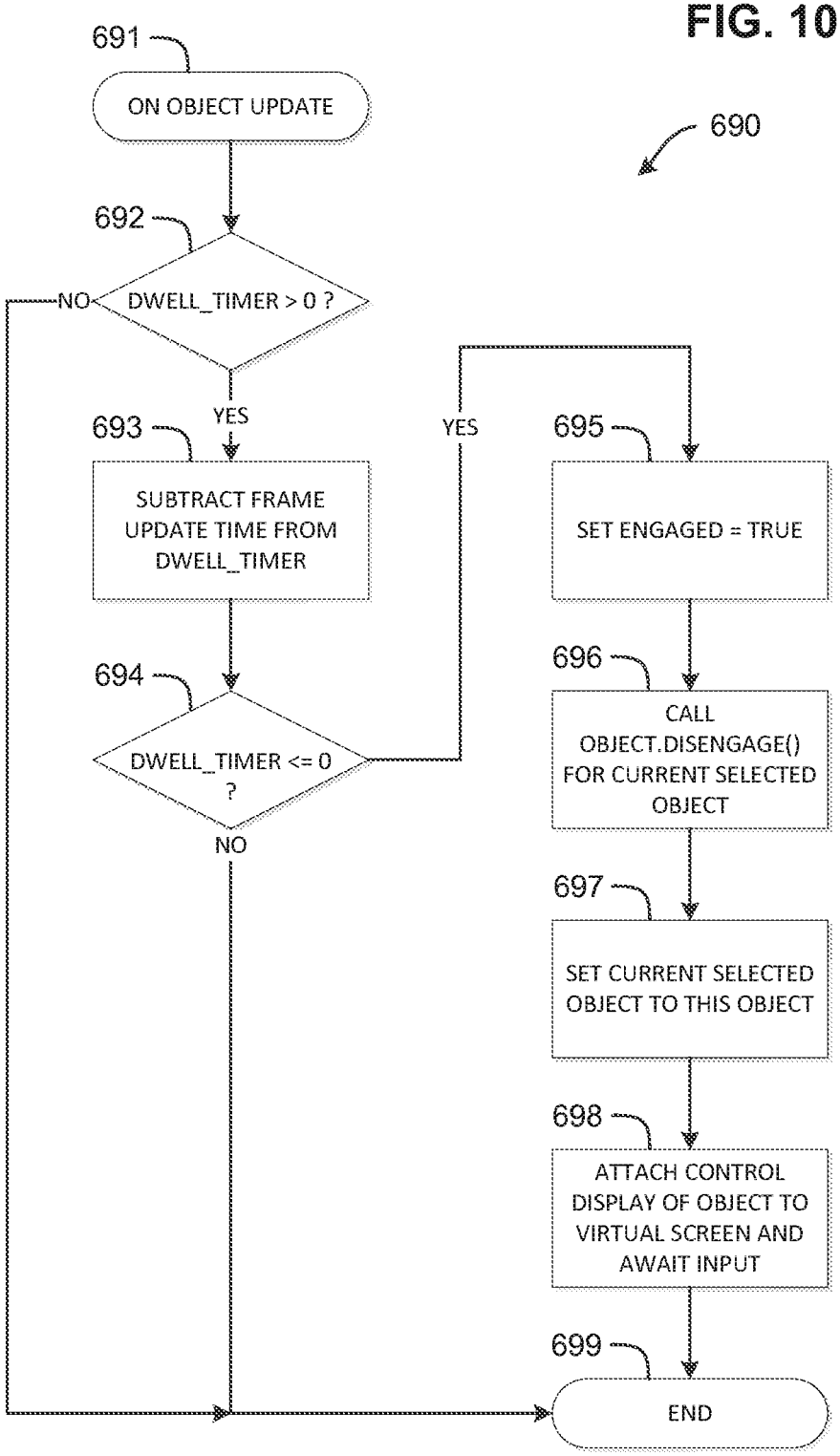
FIG. 10E is a flowchart for a data processing method performed in response to a visual object requiring visual and/or audio content updating, according to an embodiment of the present invention.

Referring now to FIG. 10E, a process 690 for updating a presentation object and potentially determining that the presentation object is at the center of attention of the player's focus is described in one embodiment. In step 691, the update process 690 begins for a given presentation object.

In step 692, a determination is made whether the value of the dwell timer (DWELL_TIMER) is greater than zero. The dwell timer variable describes a length of time of visual focus of the player on this specific visual presentation. Thus, a dwell timer greater than zero indicates that the presentation object is currently within the player's region of focus. A dwell timer that is zero or less-than-zero indicates that the player is not focused on this presentation object.

In step 693, in response to the dwell timer value being larger than zero (indicating the presentation object has current player focus), a value is subtracted from the dwell timer relating to the time it takes to update the presentation object (e.g., visual presentation 420, 520).

In step 694, a determination is made whether the newly adjusted value of the dwell timer has reached zero. If so, this indicates that the time that the player is focused upon the presentation object exceeds the dwell threshold value (DWELL_MAX) during the frame update. Thus, during this presentation object update, the presentation object will be designated the "main", "primary", or "currently selected" presentation object (e.g., primary visual presentation 410, 510). This may result in additional processing, including the shifting of presentation objects such that the primary presentation object is centered on the display, or any of the other presentation methods discussed prior.

When the dwell timer is determined to reach zero during the frame update for the presentation object (option YES at step 694), a series of steps begins that include calling functions to solely designate the primary presentation object as the currently selected object. This also includes setting values for variables to properly route input to the proper presentation object, selectively mixing audio components, providing highlighting to one or more presentation objects, among other things.

In step 695, a BOOLEAN variable ENGAGED is set to TRUE. This variable is used during this process to designate that the updated object is becoming the new currently selected presentation object. Further, this allows other computing processes outside this update process to recognize the object is currently selected. Next, in step 696, the currently selected object (being replaced) is "turned off" (from input, providing audio, etc.) by performing a set of steps to disengage the replaced selected object (e.g., steps 651-655, FIG. 10C). Next, in step 697, the updated object is designated as the new currently selected presentation object. Loosely, this corresponds to one action of the detector 330 in making a determination of player gaze-position and determining focus detection (FIG. 6). In step 698, the object is formally assigned as the new currently selected presentation object (now primary visual presentation 410, 510). This includes routing button and specified inputs to the selected presentation object, designation and highlighting of the presentation objects on the display, the initiation of selective mixing of the audio components accordingly, etc.

In step 699, in response to the player not being focused on this presentation object for a duration exceeding the dwell threshold (e.g., step 692, 694), or the completion of the designation of a specific selected presentation object (steps 695-698), the process 690 terminates.

Referring now to FIG. 11, a process 700 for updating a presentation object, determining the presentation object at the center of attention of the player's focus, and controlling fading-in and fading-out audio component combination for the audio mixer 380 for a given presentation object is described for one embodiment. The process 700 is a more advanced version of the process utilized in process 690, incorporating other options for audio control including fading percentages, volume control, and additional subroutine calls defined prior.

In step 701, the process 700 begins by being called by a particular presentation object. Each presentation object (e.g., visual presentations 410-430) of the display (e.g., interface 400) will call this generalized data processing method upon update either visually on the display or invisibly in the background as a matter of routine for display and audio maintenance.

In step 705, a determination is made whether the value of the dwell timer (DWELL_TIMER) is greater than zero. As before, the dwell timer variable describes a length of time of visual focus of the player on a specific visual presentation. While it is possible to designate a distinct dwell timer for each distinct presentation object, since the player can only focus on a single presentation object at a time (i.e., only a single center of attention is determined for the player at any given time), only a single dwell timer variable is utilized. Thus, a dwell timer greater than zero indicates that the calling presentation object is in the player's focus.

In step 709, in response to the dwell timer value being larger than zero (indicating the calling presentation object has current player focus), a value is subtracted from the dwell timer relating to the time it takes to update the calling presentation object (e.g., visual presentation 420, 520).

In step 713, a determination is made whether the value of the dwell timer has reached (or will reach) zero during this object update process. If so, this indicates that the time that the player is focused upon the presentation object exceeds the dwell threshold value (DWELL_MAX) during the frame update.

In step 717, the BOOLEAN variable FADING_IN is set to TRUE. This variable indicates the calling presentation object is becoming the new currently selected presentation object (i.e., primary visual presentation 410, 510) and the audio components associated therewith are to be faded into the audio output for the player. Next, in step 721, the currently selected object (being replaced, i.e., "old" primary visual presentation) BOOLEAN variable FADING_OUT is set to TRUE. Just as the audio of the new currently selected presentation object will be faded-in, the audio components of the replaced, currently selected object will be faded-out. In step 725, the calling presentation object is designated as the currently selected (primary visual) presentation object. Various accompanying processes may also take place upon this formal assignment, including routing button and specified input to the selected presentation object, etc.

In step 735, in response to the player not being focused on this presentation object for a duration exceeding the dwell threshold (e.g., step 705, 713), or the designation of a specific selected presentation object (steps 717-725), a determination is made using the BOOLEAN variable FADING_IN for the calling presentation object. This variable designates whether the calling presentation object audio components are fading-into the output audio stream(s) rendered to the player by one or more audio output devices. It is worth noting that only a recently newly designated and calling presentation object will have a TRUE value for FADING_IN, because once a currently selected presentation object is fully "faded-in" (i.e., outputting volume at 100%), the FADING_IN variable is set to FALSE to avoid unneeded processing.

In step 739, when it is determined that the calling object update requires audio fading-in (e.g., from a prior designation of being the currently selected object), a fade-value variable (FADE_VALUE) is determined as a ratio to designate the relative amount of "fade-in" that the current calling object is attributed during this update frame. The fade-value variable uses the difference of the value of the fading threshold (FADING_MAX) and the value of the fading timer (FADING_TIMER) measured against the value of the fading threshold to derive an appropriate volume ratio.

In step 743, the volume of the current selected presentation object is set using the FADE_VALUE ratio. Thus, the "fading-in" of the current selected presentation object begins low (close to 0%) and progresses through each pass of this updating process to achieve full (100%) volume.

In step 747, a frame update time is subtracted from the FADING_TIMER to determine how far along the fading process is in a quantitative measure. The FADING_TIMER starts at the threshold FADING_MAX during initial presentation object assignment and diminishes during this step until reaching zero.

In step 751, a determination is made as to whether the value of the FADING_TIMER variable has reached zero (indicating the fading-in process should terminate and the currently selected presentation object should be audibly rendered at full volume (no fading at this point).

In step 755, if the FADING_TIMER has expired (i.e., is less than or equal to zero), the BOOLEAN variable FADING_IN is set to FALSE for the currently selected presentation object. Regardless of whether the fading timer has expired or not, the fading-in portion of the process terminates, and the process flow continues in step 765.

In step 765, in response to the fading-in process not being required (step 735) or the fading-in process completing (steps 751, 755), a determination is made using the BOOLEAN variable FADING_OUT for the calling presentation object. This variable designates whether the calling presentation object audio components are fading-out of the output audio stream(s) rendered to the player by the one or more audio output devices.

In step 769, when it is determined that the calling object update requires audio fading-out (e.g., from a prior designation of being a replaced selected object), a fade-value variable (FADE_VALUE) is determined as a ratio of the fading timer to the fading threshold to designate the relative amount of "fade-out" that the current calling object is attributed during this update frame.

In step 773, the volume of the calling presentation object is set using the FADE_VALUE ratio. Thus, the "fading-out" of the current selected presentation object begins at full volume (100%) and progresses through each pass of this updating process to achieve full faded-out (0%) volume.

In step 777, a frame update time is subtracted from the FADING_TIMER to determine how far along the fading process is in a quantitative measure. The FADING_TIMER starts at the threshold FADING_MAX during initial presentation object assignment and diminishes during this step until reaching zero.

In step 781, a determination is made as to whether the value of the FADING_TIMER variable has reached zero (indicating the fading-out process should terminate and the calling presentation object should be completely audibly removed from the audio output.

In step 785, if the FADING_TIMER has expired (i.e., is less than or equal to zero), the BOOLEAN variable FADING_OUT is set to FALSE for the currently selected presentation object. Thus, the audio component(s) of the calling presentation object are no longer being rendered to the player by the one or more audio output devices. Regardless of whether the fading timer has expired or not, the fading-in portion of the process terminates.

In step 799, the update of the calling object terminates.

In one embodiment, the system repeats the calling of this updating process for all displayed presentation objects (i.e., visual presentations 410-430, 510-520) many times each second. The display of the presentation objects and the selective mixing and rendering of corresponding audio components in accordance with the detected region of focus and center of attention of a player during operation results in a system and method for providing an advanced player interface for concurrent gaming responsive to the determined center of attention of the player.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

What is claimed is:

1. A gaming system configured to visually present a user interface to a player, the user interface including a plurality of concurrently active gaming displayed visual presentations, the gaming system comprising:

a virtual-reality (VR) headset including one or more integrated visual output devices, the one or more visual output devices providing a virtual environment for displaying the plurality of concurrently active gaming presentations;

one or more passive input devices incorporated into the VR headset, the one or more passive input devices configured to generate positional input related to a center of attention of the player, the positional input being directly measured relative to the one or more integrated visual output devices; and one or more processors configured to:

receive the positional input, determine the center of attention of the player from the positional input, designate a primary gaming presentation from the plurality of concurrently active gaming presentations, the primary gaming presentation corresponding to the center of attention, open and display a context-sensitive menu of wager options related to the primary gaming presentation concurrently with displaying the plurality of concurrently active gaming presentations, the options being selectable and activatable by the positional input.

2. The gaming system of claim 1, wherein one or more of the plurality of concurrently active gaming presentations are wagering games.

3. The gaming system of claim 1, wherein one or more of the plurality of concurrently active gaming presentations are sporting events.

4. The gaming system of claim 1, wherein at least one of the one or more processors is configured to highlight the primary gaming presentation on the one or more integrated visual output devices using one or more visual cues.

5. The gaming system of claim 4, wherein the one or more visual cues include visually enlarging the primary gaming presentation among the plurality of concurrently active gaming presentations.

6. The gaming system of claim 4, wherein the one or more visual cues include dynamically arranging the plurality of concurrently active gaming presentations on the one or more integrated visual output devices such that the primary wagering game is close to center.

7. The gaming system of claim 1, wherein the one or more passive input devices include a camera, and the positional input is generated by tracking a position and orientation of at least one eye of the player using imagery obtained by the camera.

8. The gaming system of claim 1, wherein displaying the plurality of concurrently active gaming presentations includes displaying wager-related meters presenting data accrued from the plurality of concurrently active gaming presentations, and updating the meters responsive to player inputs.

9. The gaming system of claim 1, wherein at least one of the one or more processors is configured to generate a three-dimensional audio field to present an audio component corresponding to the primary gaming presentation via one or more audio output devices corresponding to a relative positioning of the primary gaming presentation on the one or more integrated visual output devices.

10. A gaming system configured to visually and audibly present a user interface to a player, the user interface including a plurality of concurrently active gaming presentations in virtual reality (VR), the gaming system comprising:

a VR headset including:

one or more integrated input/output units configured to provide a virtual environment for displaying the plurality of concurrently active gaming presentations including displaying wager-related meters presenting data accrued from the plurality of concurrently active gaming presentations, the one or more input/output units further configured to passively generate positional input related to a center of attention of the player, the positional input being directly measured relative to one or more integrated visual output devices; and one or more audio output units configured to output audio components corresponding to at least one of the plurality of concurrently active gaming presentations; and one or more processors configured to:

receive the positional input, determine the center of attention of the player from the positional input, designate a primary gaming presentation from the plurality of concurrently active gaming presentations, the primary gaming presentation corresponding to the center of attention, open and display a context-sensitive menu of wager options related to the primary gaming presentation concurrently with displaying the plurality of concurrently active gaming presentations, the options being selectable and activatable by the positional input, and update the wager-related meters responsive to inputs from the player.

11. The gaming system of claim 10, wherein the plurality of concurrently active gaming presentations includes one or more sporting events or one or more wagering games.

12. The gaming system of claim 11, wherein one or more of the primary gaming presentation, the context-sensitive menu, or the display of the plurality of concurrently active gaming presentations are updated to report an effect of player input.

13. The gaming system of claim 10, wherein the plurality of concurrently active gaming presentations includes at least two simultaneously conducted wagering games.

14. The gaming system of claim 10, wherein the player is actively or passively participating in at least two of the plurality of concurrently active gaming presentations simultaneously.

15. A gaming system configured for visually and audibly presenting a user interface to a player, the user interface including a plurality of simultaneously conducted gaming presentations, the gaming system comprising:

a virtual-reality (VR) headset including one or more integrated visual output devices configured to provide a virtual environment in which to display the plurality of simultaneously conducted gaming presentations;

one or more audio output devices;

one or more passive input devices incorporated into the VR headset, the one or more passive input devices configured to generate positional input related to a center of attention of the player, the positional input being directly measured relative to the one or more integrated visual output devices; and one or more processors configured to:

receive the positional input, determine the center of attention of the player from the positional input, designate a primary gaming presentation corresponding to one of the plurality of simultaneously conducted gaming presentations and being at the center of attention, open and display a context-sensitive menu of wager options related to the primary gaming presentation concurrently with displaying the plurality of concurrently active gaming presentations, the options being selectable and activatable by the positional input; and generate a three-dimensional audio field configured to present an audio component of the primary game presentation according to placement of the primary game presentation relative to the virtual environment.

16. The gaming system of claim 15, wherein in response to a predetermined event occurring in one of the non-primary ones of the plurality of simultaneously conducted gaming presentations, a primary audio component is modified to include an additional audio asset corresponding to the predetermined event.

17. The gaming system of claim 15, wherein the one or more processors are configured to display, as part of the user interface on the one or more integrated visual output devices, a contextual wagering menu specific to the primary gaming presentation.

18. The gaming system of claim 15, wherein the one or more processors are configured to determine the center of attention of the player in response to receiving similar positional input for a duration exceeding a predefined dwell time.

* * * * *